US011760514B2

(12) United States Patent
Magri et al.

(10) Patent No.: US 11,760,514 B2
(45) Date of Patent: Sep. 19, 2023

(54) MACHINE FOR STABILIZING PALLETISED LOADS WITH TENSIONING FINS

(71) Applicant: A.C.M.I.—SOCIETA' PER AZIONI, Fornovo di Taro (IT)

(72) Inventors: Giacomo Magri, Beduzzo (IT); Giorgio Oppici, Ubbiano di Solignano (IT)

(73) Assignee: A.C.M.I.—SOCIETA' PER AZIONI, Fornovo di Taro (IT)

( * ) Notice: Subject to any disclaimer, the term of this patent is extended or adjusted under 35 U.S.C. 154(b) by 0 days.

(21) Appl. No.: 17/744,904

(22) Filed: May 16, 2022

(65) Prior Publication Data

US 2022/0371758 A1 Nov. 24, 2022

(51) Int. Cl.

| | |
|---|---|
| ***B65B 11/12*** | (2006.01) |
| ***B65B 11/04*** | (2006.01) |
| ***B65B 41/12*** | (2006.01) |

(52) U.S. Cl.

CPC ..... *B65B 11/045* (2013.01); *B65B 41/12* (2013.01); *B65B 2210/20* (2013.01)

(58) Field of Classification Search

CPC ..... B65B 41/16; B65B 11/045; B65B 11/025; B65B 61/06; B65B 11/585; B65B 41/12; B65B 2210/14; B65B 51/023; B65B 2210/20

USPC ..... 53/399

See application file for complete search history.

(56) References Cited

U.S. PATENT DOCUMENTS

| | | | | |
|---|---|---|---|---|
| 4,232,501 | A | 11/1980 | Stackhouse | |
| 6,557,323 | B1 | 5/2003 | Frey | |
| 7,779,607 | B2 | 8/2010 | Lancaster, III | |
| 2009/0235617 | A1* | 9/2009 | Moore | B65B 11/045 53/461 |
| 2022/0340315 | A1* | 10/2022 | Balzani | B65B 11/045 |

FOREIGN PATENT DOCUMENTS

| | | | |
|---|---|---|---|
| IT | MO20090177 | A1 | 1/2011 |
| WO | 2021044368 | A1 | 3/2021 |

* cited by examiner

*Primary Examiner* — Chinyere J Rushing-Tucker
(74) *Attorney, Agent, or Firm* — Browdy and Neimark, PLLC

(57) ABSTRACT

A machine for stabilising palletised loads including an apparatus having a reel of covering tape, a gripping device to take a first end of the tape of the reel and make it integral with the load, a first movement apparatus to generate relative revolution of the apparatus around the load about a predetermined revolution axis, a second movement apparatus to generate relative translation motion of the apparatus with respect to the load in a direction parallel to the revolution direction, a cutting device placed in the apparatus to separate the tape from the reel, and a fixing device to fix a second end of the tape to the load. The apparatus also includes a tensioning fin configured to rotate around an articulation axis parallel to the reel axis and having a rectilinear end border, distal of and extending parallel to the articulation axis and configured to stay in contact with a longitudinal edge of the tape unwinding from the reel, and a spring acting on the fin to push the end border against the longitudinal edge of the tape.

11 Claims, 10 Drawing Sheets

MACHINE FOR STABILIZING PALLETISED LOADS WITH TENSIONING FINS

FIELD OF THE ART

The present invention relates to a machine for stabilising palletised loads, i.e., for stably blocking one or more loads above a pallet.

BACKGROUND ART

As is well known, a palletised load generally comprises a pallet, for example made of wood, plastic or other material, and one or more loads arranged on top of said pallet.

A currently very common way for stabilising palletised loads is to wrap them with a stretch film tape.

In practice, the stretch film tape is unwound from a reel and, after being subjected to an elongation step, conventionally called pre-stretch, is wound as a spiral around the palletised load, so as to form a complete wrapping.

But the stretch film is commonly made of polymeric material and consequently has a high environmental impact.

To reduce the environmental impact connected to the stabilisation of palletised loads, it has been proposed to replace the stretch film tape with a tape made of recyclable and/or biodegradable material, for example a cellulose-based material like paper.

A machine capable of performing this procedure is fully described in Italian patent application No. 102020000029396 filed on behalf of the same applicant.

The machine in question generally comprises:

- a functional arrangement provided with a reel on which a covering tape is wound,
- a gripping device adapted to take a first end of the covering tape wound on the reel and make it integral with the palletised load,
- a first movement apparatus adapted to generate a relative motion of revolution of the functional arrangement around the palletised load, according to a predetermined revolution axis, so as to unwind the covering tape from the reel and wind it around the palletised load,
- a second movement apparatus adapted to generate a relative motion of translation of the functional arrangement with respect to the palletised load in a direction parallel to the revolution axis, so as to wind the covering tape like a spiral, which continues to unwind from the reel, over the entire height of the palletised load,
- a cutting device placed in the functional arrangement to separate the covering tape from the reel at the end of the winding, and
- a fixing device adapted to fix at least a second end of the covering tape, which is obtained as a result of cutting, to the palletised load.

However, a drawback of this type of solution consists in the fact that, while winding the palletised load around the palletised load like a spiral, the paper covering tape is subjected to transversal tensions which, not being able to be compensated by the elasticity of the material (which is inextensible), can cause ripping or tears. To obviate this drawback, the second movement apparatus is generally configured so as to allow the functional arrangement to vary its orientation with respect to an oscillation axis perpendicular to the revolution axis.

In this way, the reel (which is installed in the functional arrangement) can be oriented so that its rotation axis is always perpendicular to the direction, typically like a spiral, with which the covering tape winds the palletised load, reducing transverse tensions.

Nevertheless, especially when the winding speed is quite high, the functional arrangement may be slow to adapt to the variations in inclination, with the result that one or both of the longitudinal edges of the covering tape may lose tension, forming loops and/or ripples which do not adhere to the palletised load, reducing the stability of the entire envelope.

DISCLOSURE OF THE INVENTION

In light of the above, an object of the present invention is to overcome or at least positively mitigate the aforementioned drawback of the prior art.

Another object is to achieve said objective in the context of a rational and low cost solution.

These and other objects are reached thanks to the characteristics of the invention as set forth in the independent claims. The dependent claims outline preferred and/or particularly advantageous aspects of the invention but not strictly necessary for the implementation thereof.

In particular, an embodiment of the present invention makes available a machine for stabilising palletised loads, which comprises:

- a functional arrangement provided with a reel of a covering tape, preferably made of an inextensible material and/or a cellulose-based material, such as for example paper,
- a gripping device adapted to take a first end of the covering tape of the reel and to make it integral with the palletised load,
- a first movement apparatus adapted to generate a relative motion of revolution of the functional arrangement around the palletised load, according to a predetermined revolution axis, so as to unwind the covering tape from the reel and to wind it around the palletised load, and
- a second movement apparatus adapted to generate a relative motion of translation of the functional arrangement with respect to the palletised load in a direction parallel to the revolution axis, so as to wind the covering tape like a spiral, which continues to unwind from the reel, over the entire height of the palletised load,
- a cutting device placed in the functional arrangement to separate the covering tape from the reel, and
- a fixing device adapted to fix at least a second end of the covering tape to the palletised load, wherein the functional arrangement further comprises:

- at least a first tensioning fin, which is adapted to rotate around an articulation axis parallel to the axis of the reel and is provided with a rectilinear end border, distal with respect to the articulation axis and extending parallel to the articulation axis, which is adapted to stay in contact with a longitudinal edge of the covering tape which unwinds from the reel, and
- first a spring adapted to act on the first tensioning fin to push the end border thereof against said longitudinal edge of the covering tape.

Thanks to this solution, during the winding of the palletised load, as long as the covering tape is uniformly stretched, the longitudinal edge of the same pushes the first tensioning fin in contrast with the action of the first spring without being hindered.

However, if the longitudinal edge loses tension and becomes slack, the first spring pushes the tensioning fin to rotate towards and against the longitudinal edge, locally varying its shape until it regains sufficient tension to counteract the thrust of the first spring.

In this way, the longitudinal edge is forced to remain taut like the remaining portions of the covering tape, ensuring better adherence to the palletised load and therefore better stability of the winding.

According to an aspect of the invention, the first tensioning fin can be positioned so that its end border is adapted to stay in contact with the longitudinal edge of the covering tape, in a stretch downstream of the cutting device with respect to a sliding direction of the covering tape unwinding from the reel.

In other words, the end border of the first tensioning fin can stay in contact with a stretch of the longitudinal edge of the covering tape which is interposed between the palletised load and the cutting device, that is between the latter and the gripping device.

In this way, the first tensioning fin is adapted to keep in tension precisely that portion of the longitudinal edge that is being wound around the palletised load, guaranteeing a stable wrapping.

According to another aspect of the invention, the first tensioning fin can be constituted by a flexible material, such as for example rubber.

Thanks to this solution, the first tensioning fin can adapt at least partially to the shape of the longitudinal edge, without risking abrading or tearing it.

Another aspect of the invention provides that the longitudinal edge of the covering tape on which the first tensioning fin acts is the upper longitudinal edge.

However, it is not excluded that, in other embodiments, the first tensioning fin is positioned to act on the lower longitudinal edge.

On the contrary, a preferred embodiment of the invention provides that, in addition to the first tensioning fin, the functional arrangement can also comprise:

- a second tensioning fin, which is adapted to rotate around an articulation axis parallel to the axis of the reel and is provided with a rectilinear end border, distal with respect to the articulation axis and extending parallel to the articulation axis, which is adapted to stay in contact with the longitudinal opposite edge of the covering tape unwinding from the reel, and
- a second spring adapted to act on the second tensioning fin to push the end border thereof against said opposite longitudinal edge of the covering tape.

Thanks to this solution, it is advantageously ensured that both longitudinal edges of the covering tape are always sufficiently taut to wind the palletised load in a stable and reliable manner.

According to an aspect of the invention, the articulation axis of the second tensioning fin coincides with the articulation axis of the first tensioning fin.

In this way, the two tensioning fins exert their effect substantially on the same portion of the covering tape, without creating tension imbalances.

Substantially for the same reason, another aspect of the invention provides that the distances between the articulation axis and the end borders of the two tensioning fins are substantially the same and/or that the first and the second spring are substantially the same, i.e. they are adapted to exert the same thrust on the two tensioning fins.

The second fin can also be made of a flexible material, such as rubber for example.

According to a further aspect of the invention, the functional arrangement can also comprise a fixed spatula, which is interposed between the first tensioning fin and the second tensioning fin along the direction defined by the articulation axes, said spatula being provided with a rectilinear end border, which is aligned with the end border of the first tensioning fin and with the end border of the second tensioning fin, when both the first tensioning fin and the second tensioning fin are in an angular end-of-stroke position, in which the thrust exerted by the respective first and second spring is maximum.

Thanks to this solution, the spatula can be effectively used to stretch and press the second end of the covering tape, after winding and cutting, close to the palletised load, so as to firmly fix it.

This spatula can also be made of a flexible material, such as rubber for example.

Moving on to other aspects of the machine, the latter can comprise a rest platform for the palletised load and an upper pad, superimposed on said rest platform and adapted to stay in contact with the top of the palletised load.

In this way, during the winding steps, the palletised load is stably retained between the pad and the rest platform, preventing the lateral thrusts generated by the winding of the covering tape from causing displacements and possible falls of the load.

The pad can simply be placed on the top of the palletised load or it can be pressed with a certain force towards the rest platform.

According to an aspect of the invention the gripping device may be installed on the upper pad or on the rest platform.

These placements allow a particularly convenient and simple installation of the gripping device.

The gripping device can comprise a gripper member which is adapted to grasp the first end of the covering tape and which, with respect to the relative motion of revolution of the reel around the palletised load, is adapted to remain integral with the palletised load.

This gripper member provides a particularly simple solution for blocking the first end of the covering tape to the palletised load, at least until the first windings are completed.

According to another aspect of the invention, the first movement apparatus can comprise actuator members adapted to rotate the rest platform about a rotation axis coincident with the revolution axis.

Thanks to this solution, the revolution movement of the functional arrangement is obtained indirectly, i.e., it is the palletised load which, being put in rotation by the platform, rotates on itself, while the functional arrangement remains substantially stationary in a predetermined position.

In this way, the aforesaid revolution movement is implemented quite simply.

In this context, the upper pad could simply be dragged into rotation by the palletised load with which it is in direct contact.

More preferably, the first movement apparatus can however comprise further actuator members adapted to put the upper pad in rotation around a rotation axis coincident with the revolution axis.

This prevents the palletised load, especially when defined by a stack of separate objects, from being able to twist and possibly losing stability, especially during the initial acceleration step.

Another aspect of the invention provides that the machine may also comprise lifting members adapted to bring the upper pad closer to and away from the rest platform along a direction parallel to the revolution axis.

Thanks to these lifting members, the machine can be advantageously adjusted to be used with palletised loads of different heights, furthermore the upper pad can possibly be pushed with a certain force towards the rest platform.

According to another aspect of the invention, the cutting device can comprise at least one blade and actuator members adapted to move said blade with respect to the covering tape unwinding from the reel.

The use of this movable blade represents a particularly simple and reliable solution for separating the covering tape that has been wound on the palletised load from the reel from which it originates.

According to a further aspect of the invention, the second movement apparatus can be configured to allow a variation in the orientation of the functional arrangement by rotation around an oscillation axis perpendicular to the revolution axis.

Thanks to this solution, the reel (which is installed in the functional arrangement) can be oriented so that the rotation axis thereof is always perpendicular to the direction, typically spiral-like, with which the covering tape winds the palletised load following the joint action of the revolution movement and the translational movement of the functional arrangement, avoiding the onset of transversal tensions which, especially in the case of an inextensible tape, could cause tearing or obtaining a winding that is not perfectly adherent to the palletised load.

In particular, the second movement apparatus can comprise a serial manipulator, preferably with five or six axes, to whose terminal the functional arrangement is fixed.

This serial manipulator represents a particularly robust, efficient and reliable solution for moving the reel and all the other devices associated with the rigid frame in the space surrounding the palletised load.

Alternatively, the second movement apparatus can comprise:

- a guide column,
- a carriage slidingly associated with said guide column in a direction parallel to the revolution axis,
- an articulated arm with parallel axes having a first end articulated to the carriage, and
- an articulated joint adapted to connect the functional arrangement to the second end of the articulated arm, said articulated joint defining an articulation axis coinciding with the oscillation axis.

In this way, the second movement apparatus is substantially configured as a SCARA robot, generally cheaper and simpler than a serial manipulator, but which, thanks to the presence of the articulated joint, is also able to orient the reel with respect to the oscillation axis mentioned above.

According to a different aspect of the invention, the fixing device may comprise at least a dispensing gun adapted to apply an adhesive, for example a hot glue, between the second end of the covering tape and the palletised load.

Thanks to the use of an adhesive it is advantageously possible to fix the second end of the covering tape to be fixed, without the risk of mechanically damaging the palletised load.

However, it is not excluded that, in other embodiments, the first adhesive dispensing gun may be replaced by a staple gun, a nail gun, a banding device or other.

Regardless of this, an embodiment of the present invention provides that the fixing device can be placed in the functional arrangement which also comprises the reel and the cutting device.

Thanks to this solution, the second movement apparatus is advantageously able to also move the fixing device and to position it suitably with respect to the palletised load.

According to an alternative embodiment, the fixing device can be associated with a third movement apparatus adapted to move it at least in a direction parallel to the revolution axis.

In this way, the movement of the fixing device is independent from that of the reel and the cutting device, consequently obtaining greater precision and effectiveness.

BRIEF DESCRIPTION OF THE FIGURES

Further characteristics and advantages of the invention will become clear from reading the following description provided by way of non-limiting example, with the aid of the figures illustrated in the accompanying tables.

DETAILED DESCRIPTION

Figure 1:
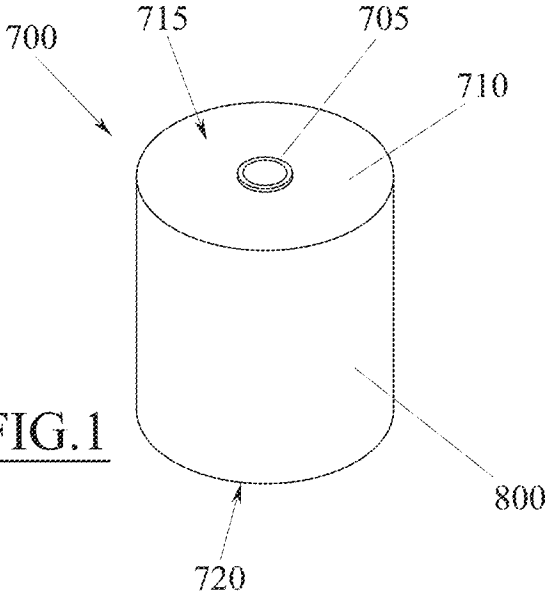
FIG. 1 is an axonometric view of a reel of covering tape adapted to be mounted on the functional arrangement of a machine for stabilising palletised loads.
Figure 2:
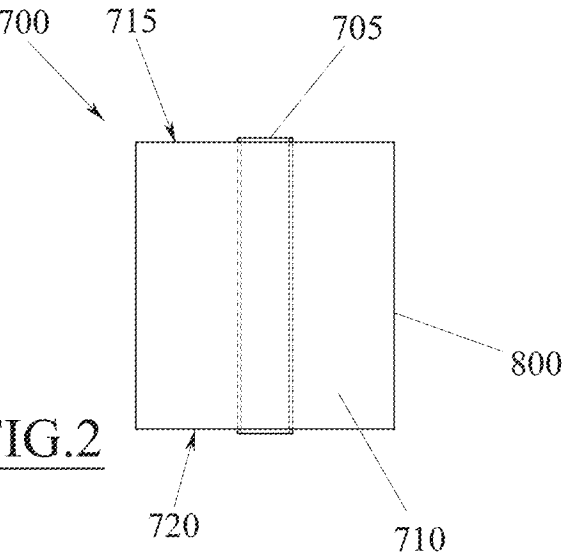
FIG. 2 is a side view of the reel of FIG. 1.
Figure 3:
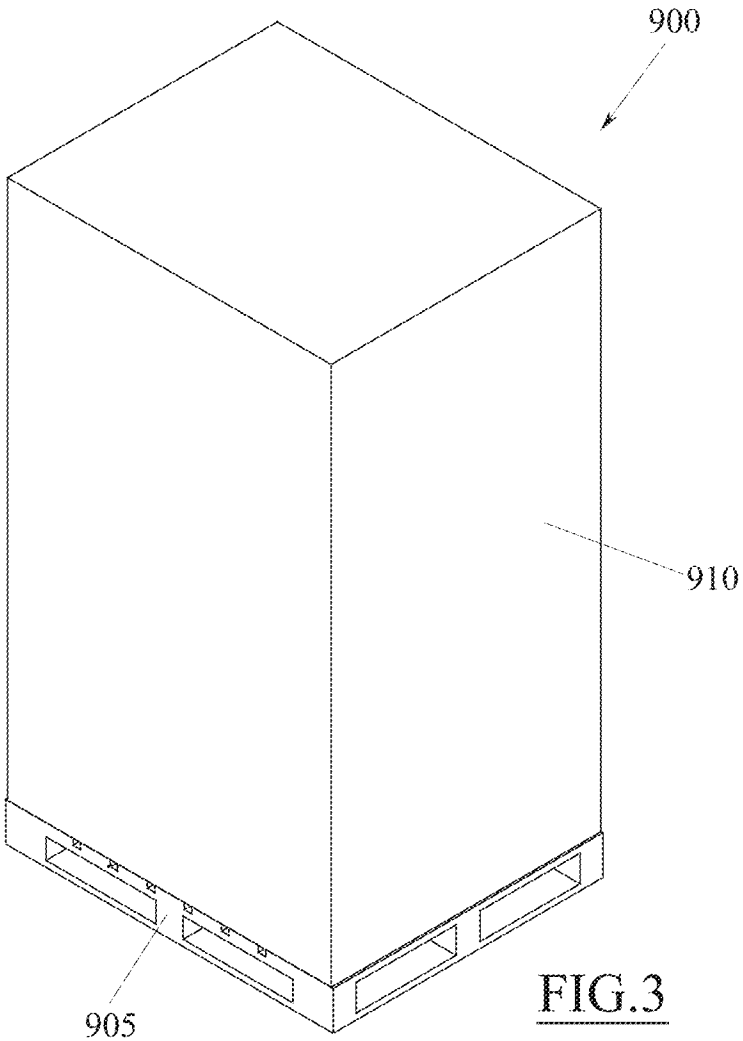
FIG. 3 is an axonometric and schematic view of a palletised load.

With the aid of the above figures, a machine 100 for stabilising palletised loads 900 is described.

A palletised load 900 generally comprises a pallet 905, for example made of wood, plastic, metal or other material, and one or more loads 910 stacked on top of said pallet 905.

Each load 910 can in turn be composed of one or more objects, such as for example an arrangement of bottles or other containers joined together to form a bundle. Stabilisation of the palletised loads 900 is achieved by wrapping with a covering tape 800.

Said covering tape 800 can be made of a cellulose-based material, for example paper, or of any other recyclable and/or biodegradable and/or compostable material.

By virtue of its nature, the covering tape 800 can therefore be generally inextensible.

The covering tape 800 can be folded in a suitably sized reel 700.

In particular, said reel 700 may comprise a tubular support 705, preferably cylindrical, which has a predetermined axis and on which the covering tape 800 is wound so as to form a roll 710 i.e. a cylindrical body formed by a plurality of mutually superimposed windings of the covering tape 800.

The axis of this roll 710, i.e., the axis of winding of the covering tape 800 around the tubular support 705, is generally coincident with the axis of the tubular support 705.

The roll 710 also has two axial ends that are flat and orthogonal to the axis of the roll 110, that is of the tubular support 705, of which a first end 715 and a second end 720.

The tubular support 705 can be made of cardboard, metal, plastic or any other suitable material.

Turning to the machine 100, it comprises first of all a functional arrangement 105 (or head), which is adapted to carry a reel 700 of the covering tape 800.

This reel 700 is rotatably associated with the functional arrangement 105, so as to be adapted to rotate on itself around a predetermined rotation axis A which generally coincides with the winding axis of the covering tape 800 that is with the axis of the tubular support 705.

In particular, the functional arrangement 105 may comprise a support shaft 125 having an axis coincident with the rotation axis A, which is adapted to be coaxially fitted in the centre of the reel 700, for example in the tubular support 705.

This support shaft 125 can be coupled to the functional arrangement 105 in a rotatable manner, in order to be adapted to rotate on itself about the rotation axis A.

The support shaft 125 is preferably an expandable shaft, for example of a mechanical and/or pneumatic type, which is adapted to vary its outer diameter from a minimum value to a maximum value.

The minimum diameter of the support shaft 125 is less than or equal to the inner diameter of the tubular support 705 of the reel 700, while the maximum diameter is potentially greater than said inner diameter.

In this way, when the support shaft 125 is in the minimum diameter configuration, the same can be fitted in the tubular support 705 of the reel 700, after which it can be actuated towards the maximum diameter configuration, so as to firmly block said tubular support 705 resulting integral with the reel 700.

It should be noted here that the support shaft 125 may not be a perfectly cylindrical body, or at least may not be so when it is in the maximum diameter configuration.

For example, the support shaft 125 may have a cylindrical body and longitudinal ribs or fins arranged radially about the axis of the cylindrical body, which are movable in a radial direction by effect of the activation of suitable actuation members.

In this way, when the support shaft 125 is in a minimum diameter configuration, said longitudinal ribs may be contained in the cylinder body or be flush therewith while, when the support shaft 125 is in a maximum diameter configuration, said ribs may protrude with respect to the cylindrical body, causing it to assume a shape assimilable to that of a splined shaft, for example.

In each of the above-mentioned configurations, the diameter of the support shaft 125 is however generally to be considered as the diameter of the smallest ideal cylinder suitable for circumscribing the support shaft 125 in that configuration.

Regardless of these considerations, the support shaft 125 is preferably installed on the cantilevered functional arrangement 105.

Figure 5:
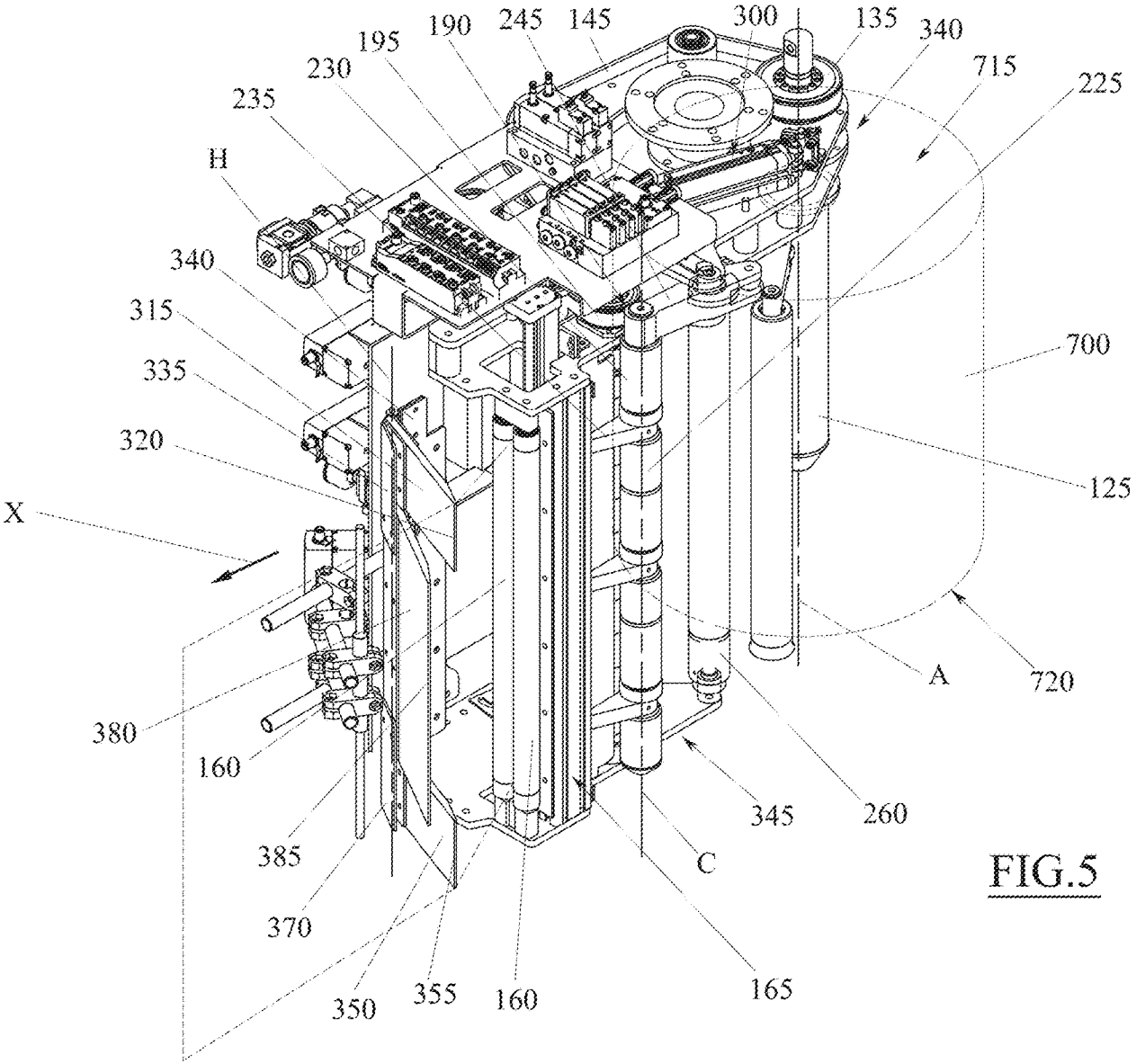
FIG. 5 is an axonometric view of a functional arrangement belonging to the machine of FIG. 4 shown with the tensioning fins slightly rotated towards the second end-of-stroke position.

In other words, as can be clearly seen for example in FIG. 5, the support shaft 125 comprises two axial ends, only one of which is physically and mechanically connected to the functional arrangement 105, for example to a structural frame thereof, while the opposite axial end is completely free.

A motor 130 (see FIG. 4) may be associated with the support shaft 125, for example an electric or hydraulic motor, which is installed on the functional arrangement 105 and adapted to put in rotation the support shaft 125 and, hence, the reel 700 connected thereto, around the rotation axis A.

This motor 130 may be connected to the support shaft 125 by means of a transmission system, which may comprise a first pulley 135 keyed to the constrained axial end of the support shaft 125, a second pulley 140 keyed to the motor shaft 130, and a flexible transmission member 145, for example a belt, wound on the first and second pulleys 135 and 140.

The functional arrangement 105 may further comprise a guide system adapted to engage the covering tape 800 unwinding from the reel 700 in a predetermined path, along which the generatrices of the covering tape 800 remain parallel to the rotation axis A of the support shaft 125, until an exit zone is reached.

At this exit zone, the guide system is adapted to engage the covering tape 800 to slide along a predetermined advancement direction X substantially rectilinear and orthogonal to the rotation axis A of the support shaft 125.

In order to impose this advancement direction X on the covering tape 800, the guide system may comprise a pair of support rollers 160, having axes parallel to each other and parallel to the rotation axis A of the support shaft 125, which are separated by a narrow gap within which the covering tape 800 may slide freely but with reduced clearance.

Each support roller 160 may be rotatably coupled to the functional arrangement 105, for example to a structural frame thereof, so as to be adapted to rotate on itself (generally in an idle mode) about its central axis.

The functional arrangement 105 may further comprise a cutting device 165, which is adapted to cut the covering tape 800 unwinding from the reel 700, so as to separate a segment thereof.

This cutting device 165 may be arranged at the exit zone, for example upstream of the support rollers 160, with respect to the advancement direction X of the covering tape 800.

Figure 9:
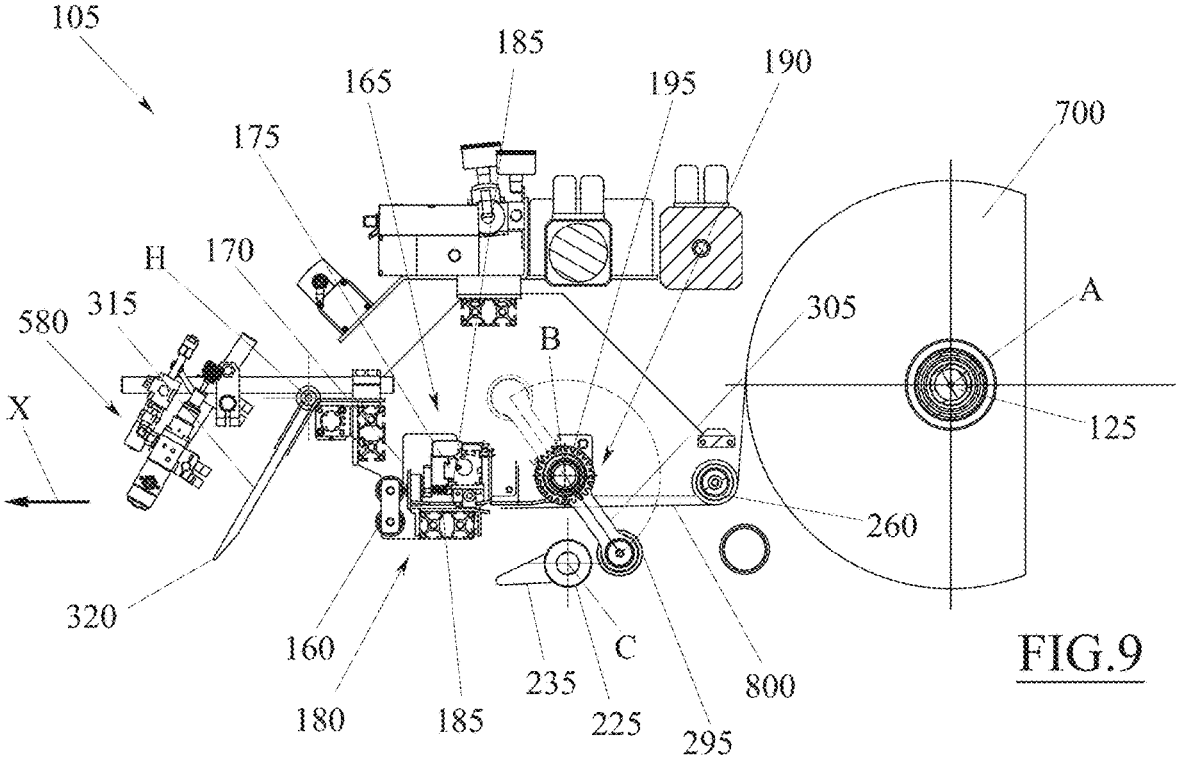
FIG. 9 is a section of the functional arrangement of FIG. 6 made with respect to a plane orthogonal to the rotation axis A of the reel 700 and passing between the upper planar structure 340 and the lower planar structure 345, in which the second return roller 295 is in the disengagement position.
Figure 10:
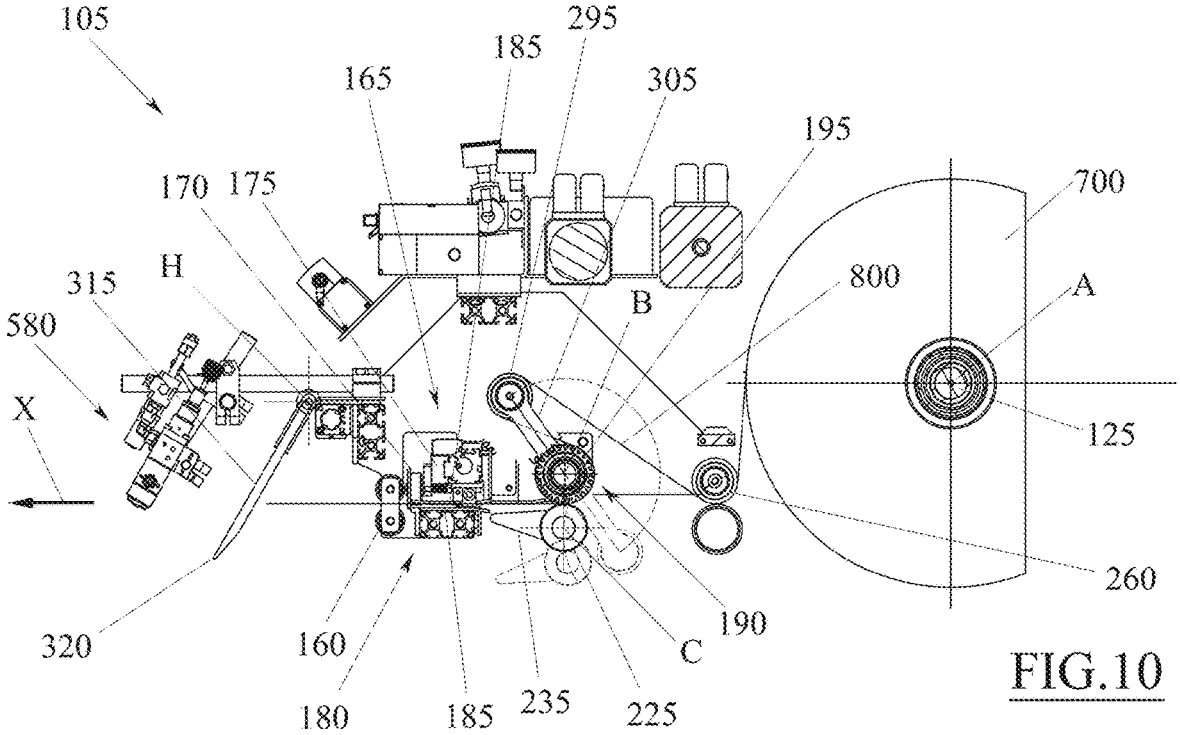
FIG. 10 is the section of FIG. 12 in which the second return roller 295 is in the engagement position.

As visible in the detail of FIGS. 9 and 10, the cutting device 165 can comprise a blade 170, for example a rotating blade, and actuator members 175 adapted to move said blade 170 with respect to the covering tape 800 unwinding from the reel 700.

In particular, the blade 170 can be driven for moving in a sliding direction parallel to the covering tape 800 but transversal, typically orthogonal, with respect to an advancement direction X with which said covering tape 800 unwinds from the reel 700.

For example, the sliding direction of the blade 170 can be parallel to the rotation axis A of the reel 125.

In this way, the sliding of the blade 170 allows the covering tape 800 to be cut through along its entire width, subdividing it into two separate segments.

The actuator members 175 of the blade 170 can comprise a cylinder/piston arrangement of the pneumatic type or any other device adapted to impose a linear type movement on the blade 170.

To allow an effective cutting of the covering tape 800, the functional arrangement 105 may also comprise a blocking device 180 operatively arranged between the support shaft 125, on which the reel 700 is mounted, and the cutting device 165.

Operatively arranged means that the blocking device 180 is adapted to act on a stretch of the covering tape 800 which is comprised between the support shaft 125 (i.e., the reel 700) and the cutting device 165.

In particular, the blocking device 180 is preferably placed near, for example substantially close to the blade 170 and is adapted to stably block the covering tape 800 to allow/facilitate the cutting action by the blade 170.

This blocking device 180 may comprise a pair of plates 185, flat and mutually opposed, which are arranged parallel to each other and parallel to the rotation axis A of the support roller 125 and between which the covering tape 800 passes.

These plates 185 can be associated with actuator members (not visible) adapted to engage them in a relative movement, for example in a direction orthogonal to the covering tape 800 that crosses them, between a distanced configuration and a neared configuration.

This relative movement can be obtained for example by keeping one of the two plates 185 stationary and by moving the other towards/away from the first one.

When the plates 185 are in a distanced configuration (as illustrated in FIG. 9 *e* 10), the covering tape 800 passes through them with a certain clearance, thus resulting free to slide.

On the other hand, when the plates 185 are in a neared configuration (not illustrated), the covering tape 800 is stably blocked and clamped between the plates 185, which prevent it from advancing.

The actuator members of the plates 185 can comprise a cylinder/piston arrangement of the pneumatic type or any other device suitable for the purpose, for example of the electromechanical type.

As mentioned above, a gap in which the covering tape 800 can pass freely but with preferably reduced clearance remains defined between the plates 185 in the distanced configuration.

In this configuration, the plates 185 thus also act as guides for the covering tape 800 in the advancement direction X.

In fact, the plates 185 are preferably oriented so as to be parallel to the advancement direction X and the gap between them can be aligned, along the same advancement direction X, with the gap defined between the support rollers 160.

In other embodiments, the support rollers 160 might be absent and the guide system of the covering tape 800, at the exit zone, might be defined by the plates 185 only associated with the blocking device 180.

To advance the covering tape 800 after a cutting operation, the functional arrangement 105 may further comprise an actuation device 190 operatively positioned between the blocking device 180 and the support shaft 125 on which the reel 700 is mounted.

Operatively positioned means that the actuation device 190 acts on a stretch of the covering tape 800 between the support shaft 125 (i.e., the reel 700) and the blocking device 180, preferably resulting close to the latter.

Another function of the actuation device 190 may be to brake the sliding of the covering tape 800 during the winding of the palletised load 900.

This actuation device 190 can comprise a drive roller 195 adapted to receive the covering tape 800 in contact, and a motor 200 (visible FIG. 4) adapted to put the drive roller 195 in rotation around its central axis B.

Figure 8:
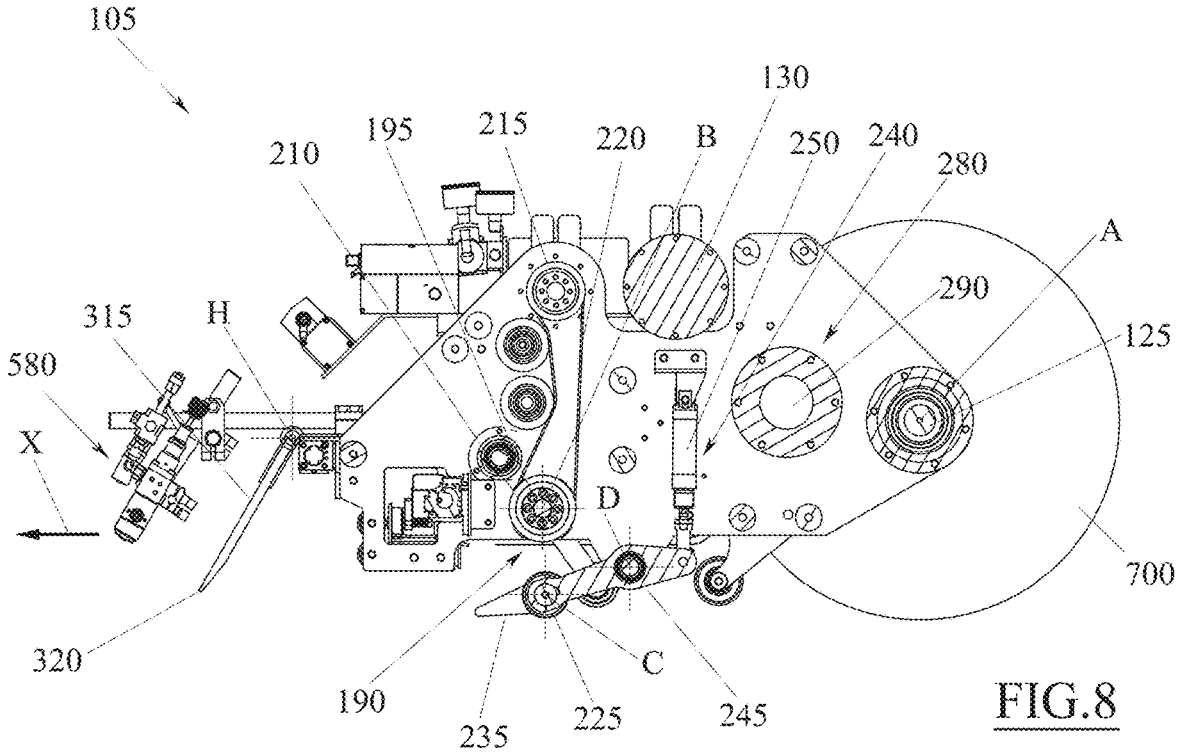
FIG. 8 is a section of the functional arrangement of FIG. 6, made with respect to a plane orthogonal to the rotation axis A of the reel 700 and passing between the plates of the upper planar structure 340.

This motor 200 may be connected to the drive roller 195 by means of a transmission system (see FIG. 8), which may comprise a first pulley 210 keyed to an axial end of the drive roller 195, a second pulley 215 keyed to the shaft of the motor 200, and a flexible transmission member 220, for example a belt, wound on the first and second pulley 210 and 215.

The central axis B of the drive roller 195 is preferably parallel to the rotation axis A of the reel 700.

The actuation device 190 can further comprise a contrast roller 225, which is adapted to rotate on itself (typically in an idle mode) around its own central axis C, and is adapted to press the covering tape 800 against the drive roller 195.

The central axis C of the contrast roller 225 is preferably parallel to the central axis B of the drive roller 195.

Figure 6:
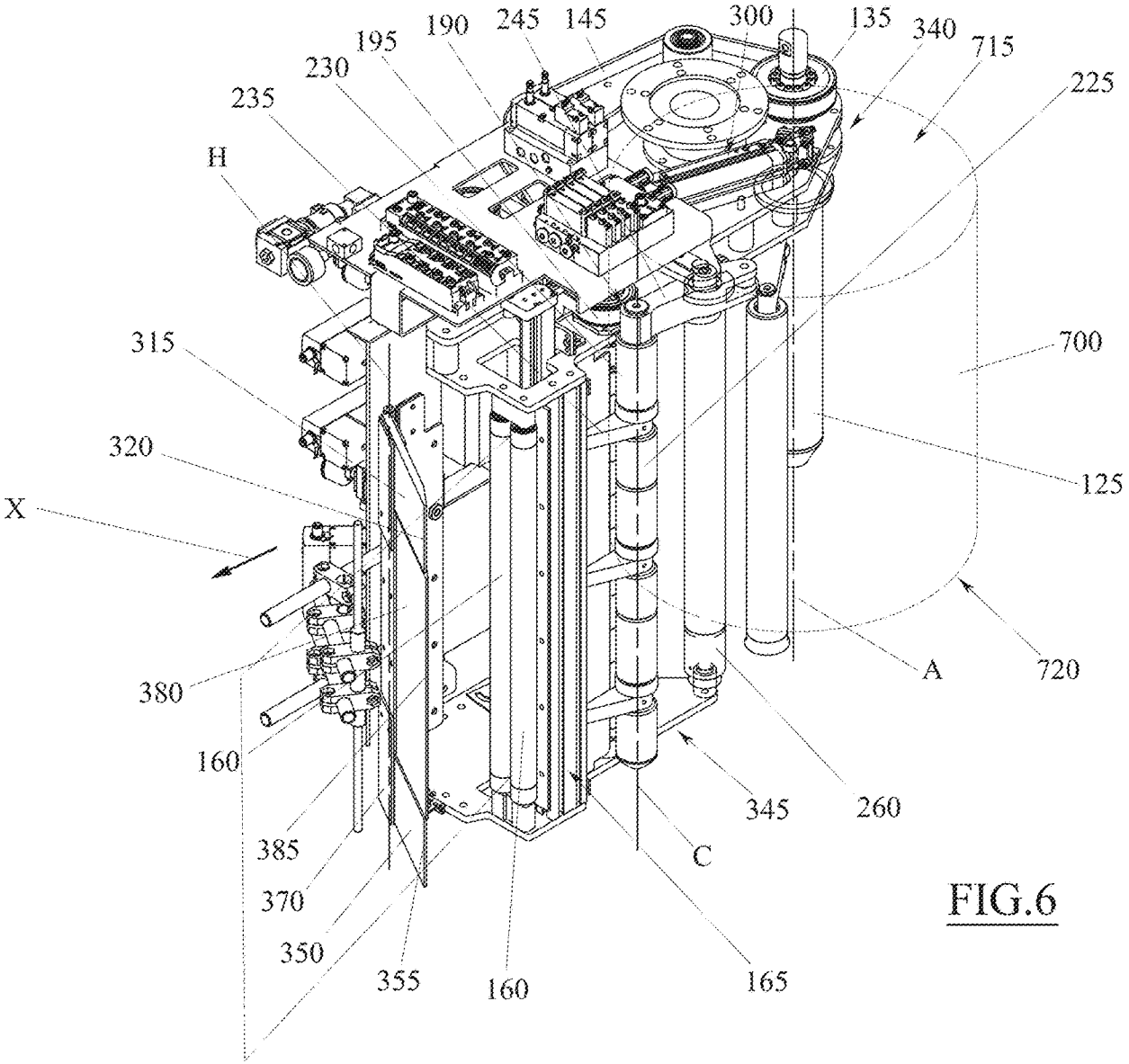
FIG. 6 is the view of FIG. 5 in which the tensioning fins are in the first end-of-stroke position.

As illustrated in FIGS. 5 and 6, this contrast roller 225 may be axially subdivided into a plurality of cylindrical sections 230, mutually coaxial, aligned along the central axis C and preferably having the same diameter, which are adapted to come into contact with the drive roller 195.

These cylindrical sections 230 may be interspersed with one or more guide prongs 235, which are mutually parallel and protrude radially with respect to the cylindrical sections 230, the function of which is to direct the covering tape 800 unwinding from the reel 700 in the advancement direction, for example towards the cutting device 165.

Regardless of these considerations, the contrast roller 225 is preferably installed on the cantilevered functional arrangement 105.

In other words, as can be clearly seen for example in FIG. 5, the contrast roller 225 comprises two axial ends, only one of which is physically and mechanically connected to the functional arrangement 105, for example to a structural frame thereof, while the opposite axial end is completely free.

In particular, it is preferable that the contrast roller 225 is oriented in the same direction as the support shaft 125.

That is to say, it is preferable that, from the respective constrained end to the respective free end, the contrast roller 225 and the support shaft 125 extend in the same direction.

In other embodiments, instead of the contrast roller 225, it could be the drive roller 195 that is mounted cantilevered in the same manner as outlined for the contrast roller 225; or, both the contrast roller 225 and the drive roller 195 could be mounted cantilevered in said manner.

In any case, the actuation device 190 can further comprise actuator members 240 (see FIG. 8) adapted to engage the drive roller 195 and the contrast roller 225 in a relative movement, for example in a direction transversal to the respective central axes B and C, between a distanced configuration and a neared configuration.

When the drive roller 195 and the contrast roller 225 are in a distanced configuration (as in FIG. 8), a gap is defined between them, which is also open laterally at the free end of the contrast roller 225 (and/or possibly of the drive roller 195), which is preferably aligned with the advancement direction X of the covering tape 800 and through which the covering tape 800 can slide and pass freely.

When, on the other hand, the drive roller 195 and the contrast roller 225 are in a neared configuration (as illustrated in FIG. 10), the covering tape 800 is stably blocked and damped between these two rollers, so that the sliding thereof in the advancement direction X and/or its braking are generated by the rotation of the drive roller 195.

This relative movement between the distanced position and the neared position can be obtained by keeping the drive roller 195 stationary and by moving only the contrast roller 225 towards/away from the drive roller 195.

For example, the constrained end of the contrast roller 225 can be rotatably coupled to at least one lever 245, shaped for example as a rocker arm, which is rotatably coupled to the functional arrangement 105, for example to a structural frame thereof, so as to be adapted to rotate around a rotation axis D, which is parallel to but distanced both with respect to the central axis C of the contrast roller 225 and with respect to the central axis B of the drive roller 195.

By making the lever 245 rotate around said rotation axis D, the actuator members 240 are therefore able to move the contrast roller 225 towards/away from the drive roller 195.

These actuator members 240 can comprise for example a cylinder/piston arrangement 250 of the pneumatic type or any other device suitable for the purpose, for example of the electromechanical type.

Although a solution has been described in which the contrast roller 225 is actively displaced with respect to the drive roller 195, it cannot be ruled out that, in other embodiments, it is the drive roller 195 that is actively displaced with respect to the contrast roller 225.

The functional arrangement 105 may further comprise a first return roller 260, having an axis parallel to the axis A of the support shaft 125 and rotating on itself around its own axis (preferably in an idle mode), which is operatively positioned between the actuation device 190 and the support shaft 125 on which the reel 700 is mounted.

Operatively positioned means that the first return roller 260 is adapted to interact with a stretch of the covering tape 800 between the actuation device 190 and the support shaft 125 (i.e., the reel 700).

This first return roller 260 may be positioned and dimensioned so as to result substantially tangent to at least one imaginary plane that is parallel to the rotation axis A of the support shaft 125 and that passes through the gap comprised by the drive roller 195 and the contrast roller 225, when the latter are in a distanced configuration, resulting for example parallel to the advancement direction X of the covering tape 800 in the exit zone.

In this way, the first return roller 260 is adapted to divert the path of the covering tape 800 unwinding from the reel 700, directing it in the advancement direction X.

The functional arrangement 105 may also comprise a second return roller 295 (see FIGS. 9 and 10), also having an axis parallel to the axis of the support shaft 125 and rotatable on itself about its own axis (preferably in an idle mode), which is operatively positioned between the actuation device 190 and the first return roller 260.

Operatively positioned means that the second return roller 295 is adapted to interact with a stretch of the covering tape 800 between the actuation device 190 and the first return roller 260.

This second return roller 295 is also preferably installed on the cantilevered functional arrangement 105.

In other words, although not clearly visible in the figures, also the second return roller 295 comprises two axial ends, only one of which is physically and mechanically connected to the functional arrangement 105, for example to a structural frame thereof, while the opposite axial end is completely free.

In particular, it is preferable that the second return roller 295 is oriented in the same direction as the support shaft 125.

That is to say, it is preferable that, from the respective constrained end to the respective free end, the second return roller 295 and the support shaft 125 extend in the same direction.

Figure 7:
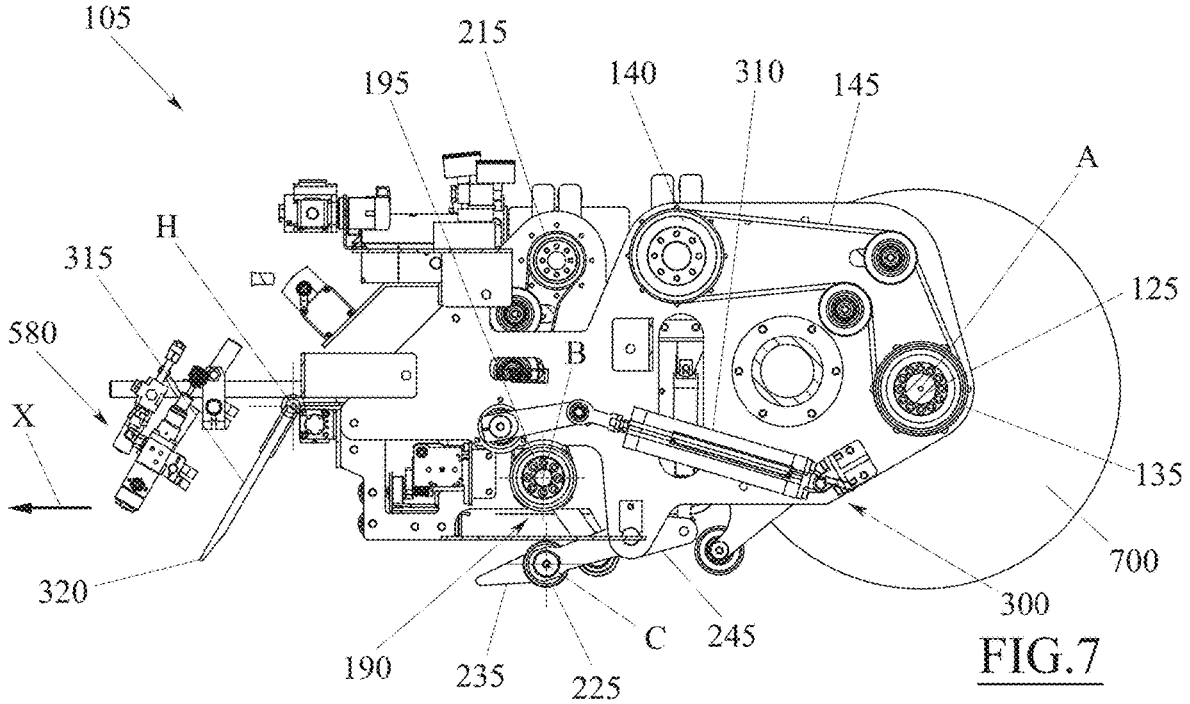
FIG. 7 is a top view of the functional arrangement in FIG. 6, in which some elements have been removed to better display the elements below.

The functional arrangement 105 may therefore comprise actuator members 300 (see FIG. 7) adapted to move the second return roller 295 in a transverse direction with respect to its axis between a disengagement position and an engagement position.

In the disengagement position (see FIG. 9), the axis of the second return roller 295 is located in one of the two half-spaces which are defined by the imaginary plane containing the rotation axis B of the drive roller 195 and the rotation axis of the first roller 260 of the second return roller 260, preferably in the half-space in which the rotation axis C of the contrast roller 225 is contained.

In the engagement position (see FIG. 10), the axis of the second return roller 295 is instead positioned in the opposite half-space, after having passed between the first return roller 260 and the drive roller 195.

This movement of the second return roller 295 can be achieved by rotating the second return roller 295 about a revolution axis parallel to but distanced from the axis of the second return roller 295, for example about a revolution axis coincident with the rotation axis B of the drive roller 195.

For example, the constrained end of the second return roller 295 may be rotatably coupled to at least one lever 305, which is rotatably coupled to the functional arrangement 105, for example to a structural frame thereof, according to the already mentioned revolution axis, and the actuator members 300 may be adapted to rotate said lever 305 around said revolution axis.

These actuator members 300 may comprise, for example, a jack 310 (see FIG. 7) of the electric, pneumatic or any other type, which is adapted to put the lever 305 in rotation by means of a gear or any other transmission system.

In alternative, the actuator members 300 could comprise an electric or pneumatic motor or any other device suitable for the purpose, for example of the electromechanical type.

In any case, in order to pass from the disengagement position to the engagement position, the actuator members 300 can engage the second return roller 295 to perform a rotation of about 180° sexagesimal about the revolution axis.

In this way, passing around the first return roller 260 of the second return roller 255, around the tensioning roller 295 and around the drive roller 195, the covering tape 800 is engaged to perform a tortuous path that defines a sort of tape stock or storage, the extension of which varies according to the position of the second return roller 295, the displacement of which can be managed in such a way as to keep the covering tape 800 at an optimal tension throughout the winding of the palletised load 900.

In fact, during operation of the machine 100, the actuator members 300 can be configured to allow an adjustment of the angular position of the second return roller 295 within an angle of about 20° starting from the engagement position towards the disengagement position, preferably remaining in the same half-space and thus without passing through the drive roller 195 and the first return roller 260 again.

The functional arrangement 105 at least a first tensioning fin 315, which can be operatively installed downstream of the cutting device 165, with respect to the advancement direction X of the covering tape 800.

In other words, the first tensioning fin 315 can be installed so that, during the winding of a palletised load 900, it is operatively positioned between the cutting device 165 and the palletised load 900.

Operatively positioned means that the first tensioning fin 315 is adapted to act on a stretch of the covering tape 800 comprised between the cutting device 165 and the palletised load 900.

For example, the first tensioning fin 315 can be positioned on the opposite side of the cutting device 165 with respect to the position occupied by the advancement device 190.

The support rollers 160 (if any) can be positioned between the cutting device 165 and this first tensioning fin 315.

The first tensioning fin 315 is rotatably associated with the functional arrangement 105 so as to be able to rotate around a predetermined articulation axis H.

The articulation axis H of the first tensioning fin 315 is preferably parallel to the rotation axis A of the support shaft 125.

The first tensioning fin 315 is preferably shaped as a substantially flat body, for example rectangular, which is oriented parallel to the articulation axis H.

In particular, the first tensioning fin 315 comprises a rectilinear end border 320, distal from the articulation axis H and extending parallel to the articulation axis H.

Figure 12:
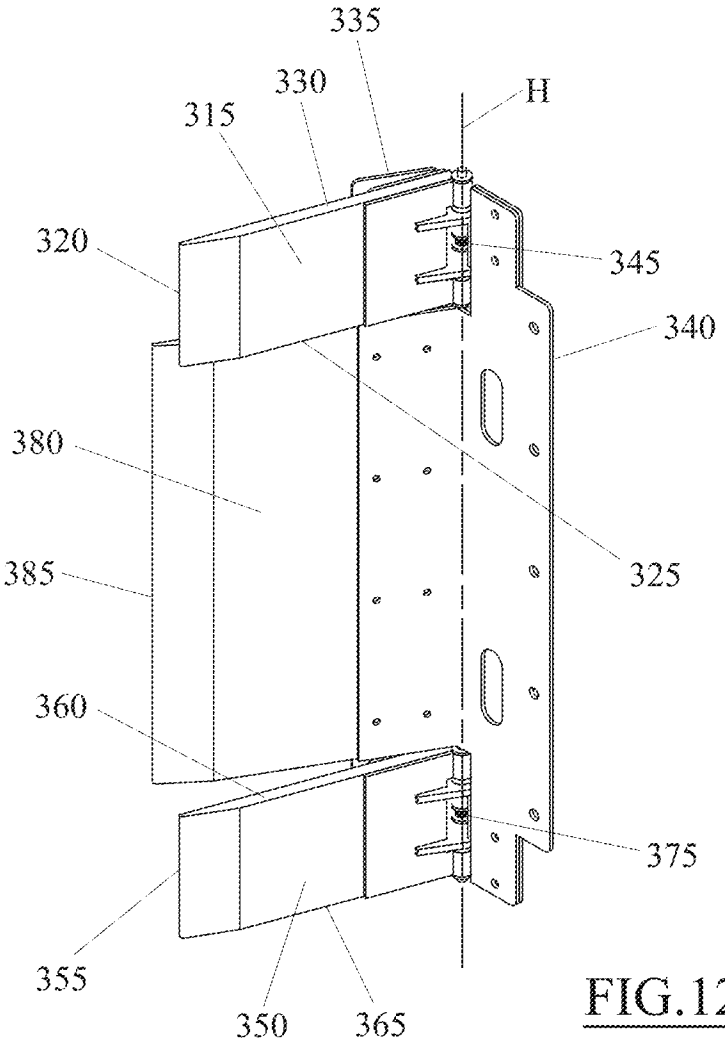
FIG. 12 is the view of FIG. 11 with the tensioning fins slightly rotated towards the second end-of-stroke position.
Figure 11:
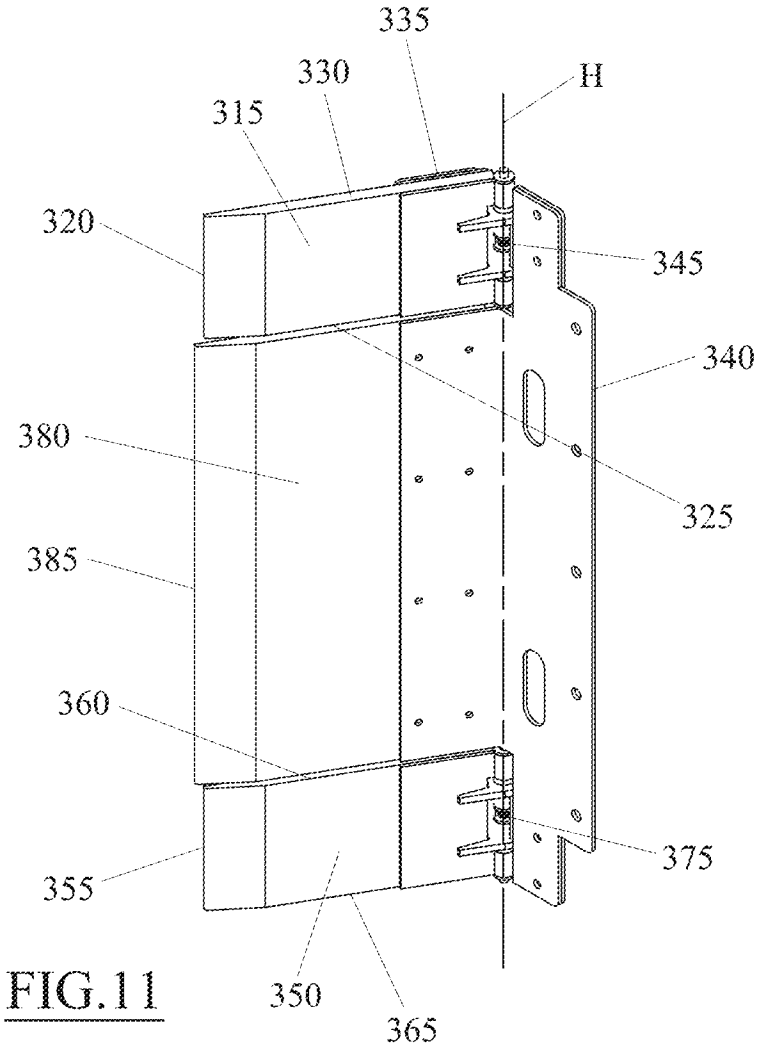
FIG. 11 is an axonometric view of the tensioning fins in the first end-of-stroke position.

This end border 320 can extend between two lateral flanks of the first tensioning fin 315, of which an internal lateral flank 325 and an external lateral flank 330, which lie in respective planes substantially orthogonal to the articulation axis H (see FIGS. 11 and 12).

Figure 13:
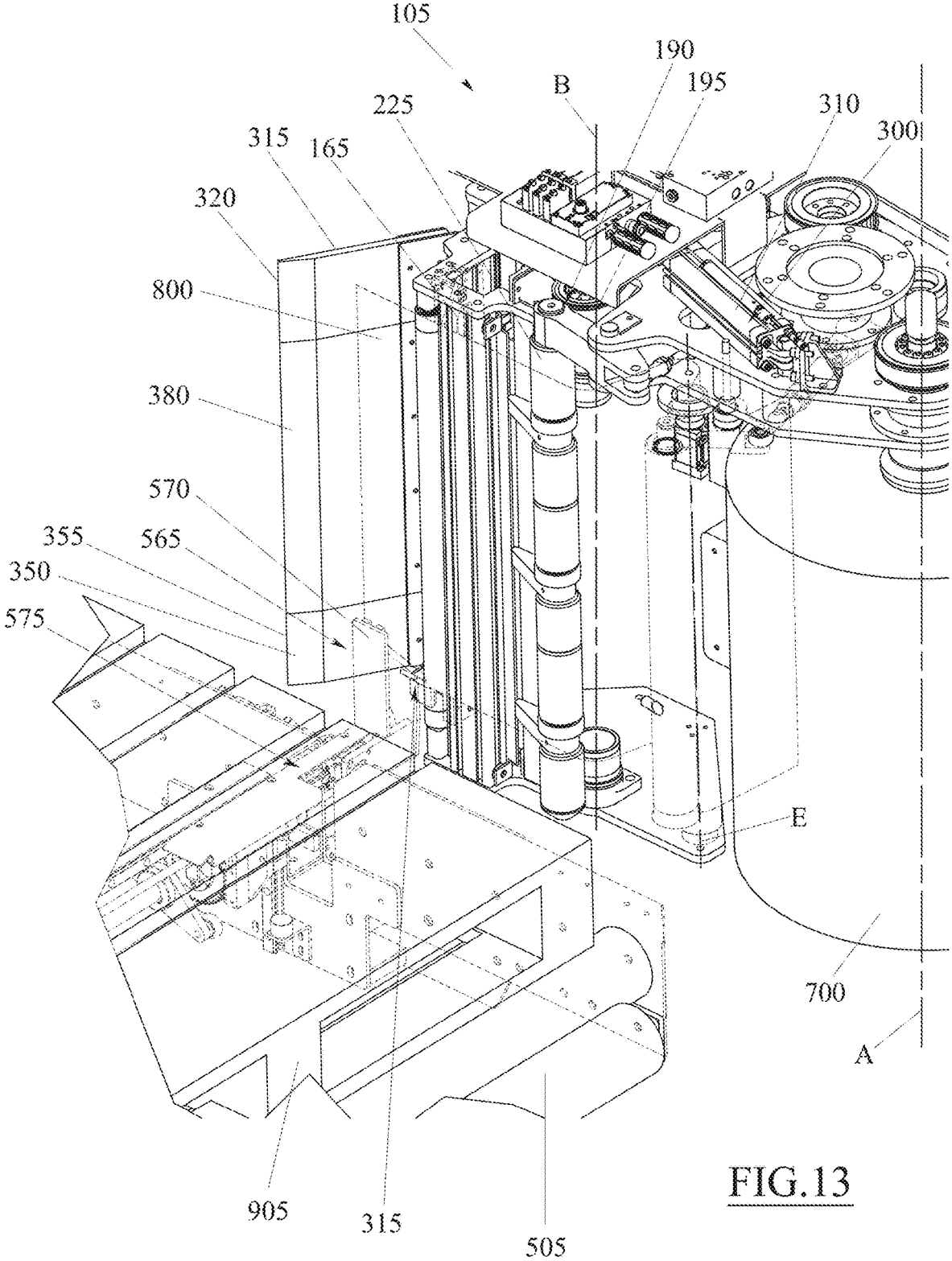
FIG. 13 is an axonometric view showing the functional arrangement of the machine in proximity to a pallet.

In particular, the internal lateral flank 325 can lie in a plane which ideally intersects the roll 710 of the reel installed on the support shaft 125, at an intermediate point between the first axial end 715 and the second axial end 720 (see FIGS. 5, 6 and 13).

The external lateral flank 330 can instead be substantially coplanar with the first axial end 715 of the roll 710, or more preferably it can lie in a plane which ideally passes outside the roll 710, or which is not adapted to intersect it.

The first tensioning fin 315 can be made of a flexible and/or elastic material, such as rubber for example.

By rotating around the articulation axis H, the first tensioning fin 315 can oscillate between a first end-of-stroke position (illustrated for example in FIG. 6) and a second end-of-stroke position (in the direction illustrated for example in FIG. 5).

These end-of-stroke positions can be defined by two flat plates 335 and 340, lying in planes passing through the articulation axis H and arranged so as to define a dihedral, inside which the first tensioning fin 315 is contained.

However, it is not excluded that, in other embodiments, the end-of-stroke positions may be defined by any other pair of bodies capable of limiting the rotation of the first tensioning fin 315, within a determined angular interval.

In any case, when the first tensioning fin 315 is in the first end-of-stroke position, it can be positioned so as to ideally intersect the advancement direction X with which the covering tape 800 passes through the cutting device 165 (see FIGS. 7-10).

With respect to this advancement direction X, the first tensioning fin 315 in the first end-of-stroke position can be inclined by an angle comprised between 0° and 90° (extremes excluded), preferably by an angle comprised between 20° and 70° (extremes included).

By rotating from the first end-of-stroke position towards the second end-of-stroke position (in the direction illustrated in FIGS. 5, 12 and 15), the inclination of the first tensioning fin 315 with respect to the advancement direction X tends to increase, i.e. the first tensioning fin 315 moves towards a condition of perpendicularity with respect to the advancement direction X (without necessarily reaching it).

In this way, the rotation of the first tensioning fin 315 from the first end-of-stroke position towards the second end-of-stroke position generally causes the end border 320 to move away with respect to the plane in which the covering tape 800 lies at the outlet of the functional arrangement 105, that is in which the covering tape 800 lies as it passes through the cutting device 165 and/or blocking device 180.

Figure 14:
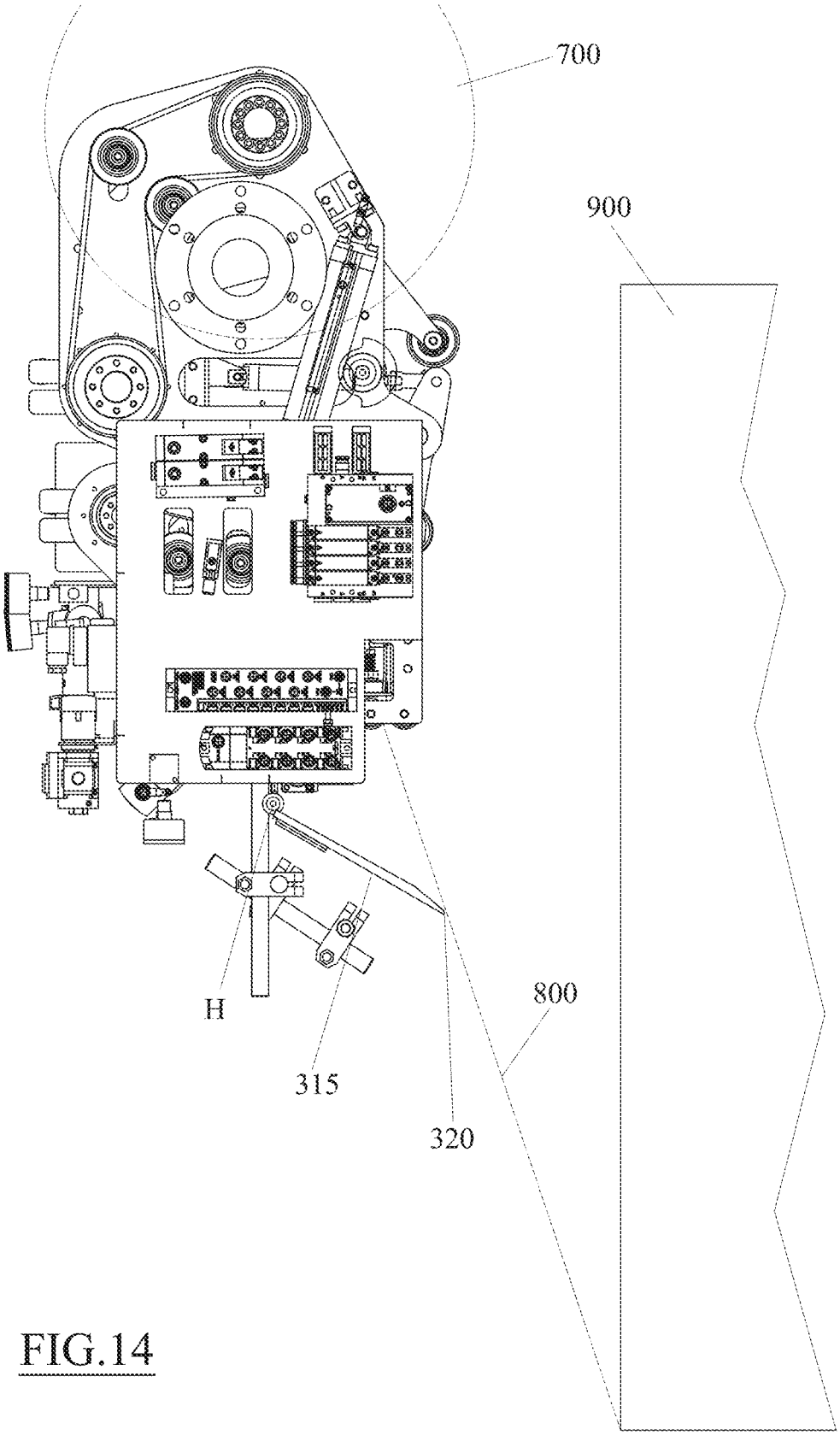
FIGS. 14 and 15 show the functional arrangement from above during two different moments in the winding process of the palletised load.
Figure 15:
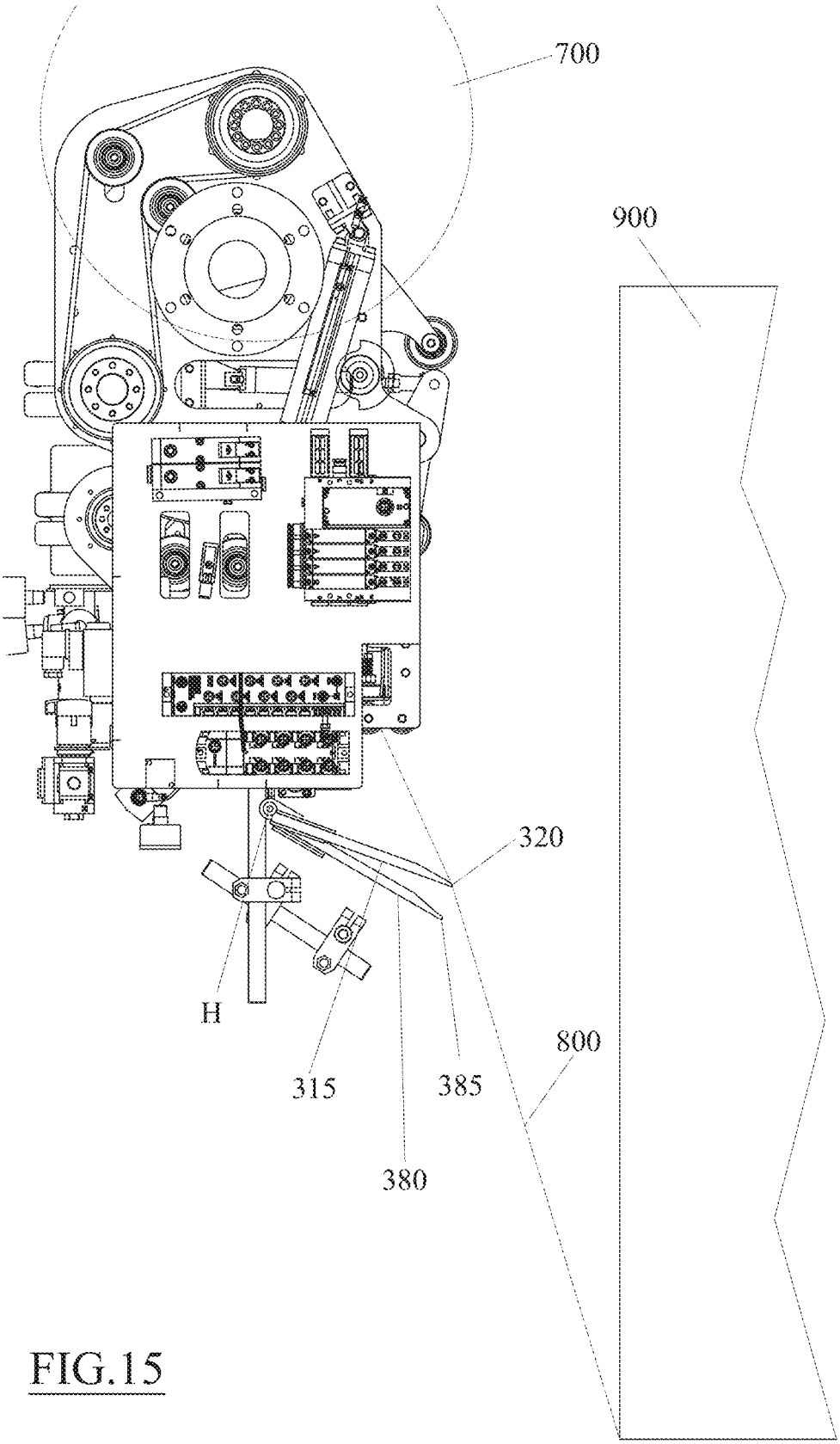

In other words, by rotating from the first end-of-stroke position towards the second end-of-stroke position, the end border 320 of the first tensioning fin 315 tends to approach the rotation axis A of the support shaft 125 and, in doing so, tends to increase the inclination between the advancement direction X of the covering tape 800 and the first tensioning fin 315 (see FIGS. 14 and 15).

A spring 345 is also associated with the first tensioning fin 315, for example but not necessarily a bending spring, which is adapted to push the first tensioning fin 315 to rotate around the articulation axis H from the first end-of-stroke position (in which the spring 345 is loaded to the maximum and therefore exerts the maximum force) towards the second end-of-stroke position.

In this way, the end border 320 of the first tensioning fin 315 is constantly pushed towards and against a longitudinal edge of the covering tape 800 unwinding from the reel 110.

By longitudinal edge it is meant one of the two edges of the covering tape 800 which extend parallel to the advancement direction, that is, perpendicular to the rotation axis A of the support shaft 125 on which the reel 800 is installed.

In this case, the end border 320 of the first tensioning fin 315 is pushed against the longitudinal edge of the covering tape 800 which, at the reel 700, defines the first end 715 of the roll 710.

In working conditions, in which the axis A of the support shaft 125 is oriented substantially vertically or in any case inclined from the bottom upwards, the longitudinal edge of the covering tape 800, against which the end border 320 of the first tensioning fin 315 abuts, is generally the upper one.

The functional arrangement 105 can also comprise a second tensioning fin 350 substantially similar to the previous one but adapted to act against the opposite longitudinal edge of the covering tape, that is generally the lower one.

In particular, also the second tensioning fin 350 can be operatively installed downstream of the cutting device 165, with respect to the advancement direction X of the covering tape 800.

In other words, also the second tensioning fin 350 can be installed so that, during the winding of a palletised load 900, it is operatively positioned between the cutting device 165 and the palletised load 900.

Operatively positioned means that the second tensioning fin 350 is adapted to act on a stretch of the covering tape 800 comprised between the cutting device 165 and the palletised load 900.

For example, the second tensioning fin 350 can be positioned on the opposite side of the cutting device 165 with respect to the position occupied by the advancement device 190.

The support rollers 160 (if any) can be positioned between the cutting device 165 and this second tensioning fin 350.

The second tensioning fin 350 is rotatably associated with the functional arrangement 105 so as to be adapted to rotate around a predetermined articulation axis, which is preferably parallel to the rotation axis A of the support shaft 125.

In particular, the rotation axis of the second tensioning fin 350 is preferably coincident with the rotation axis H of the first tensioning fin 315.

The second tensioning fin 350 is preferably shaped as a substantially flat body, for example rectangular, which is oriented parallel to the articulation axis H.

For example, the second tensioning fin 350 can be substantially identical to the first tensioning fin 315.

In particular, the second tensioning fin 350 comprises a rectilinear end border 355, distal from the articulation axis H and extending parallel to the articulation axis H.

This end border 355 can extend between two lateral flanks of the second tensioning fin 350, of which an internal lateral flank 360 and an external lateral flank 365, which lie in respective planes substantially orthogonal to the articulation axis H (see FIGS. 11 and 12).

In particular, the internal lateral flank 360 can lie in a plane which ideally intersects the roll 710 of the reel installed on the support shaft 125, at an intermediate point between the first axial end 715 and the second axial end 720 (see FIGS. 5, 6 and 13).

The external lateral flank 365 can instead be substantially coplanar with the second axial end 720 of the roll 710, or more preferably it can lie in a plane which ideally passes outside the roll 710, or which is not adapted to intersect it.

The second tensioning fin 350 can be made of a flexible and/or elastic material, such as for example rubber.

By rotating around the articulation axis H, the second tensioning fin 350 can oscillate between a first end-of-stroke position (illustrated for example in FIG. 6) and a second end-of-stroke position (in the direction illustrated for example in FIG. 5).

These end-of-stroke positions can be defined by the flat plate 340 and by a further flat plate 370, which lie in planes passing through the articulation axis H and are arranged so as to define a dihedral, inside which the second tensioning fin 350 is contained.

However, it is not excluded that, in other embodiments, the end-of-stroke positions may be defined by any other pair of bodies capable of limiting the rotation of the first tensioning fin 350, within a determined angular interval.

In any case, when the second tensioning fin 350 is in the first end-of-stroke position, it can be positioned so as to ideally intersect the advancement direction X with which the covering tape 800 passes through the cutting device 165 (see FIGS. 7-10).

With respect to this advancement direction X, the second tensioning fin 350 in the first end-of-stroke position can be inclined by an angle between 0° and 90° (extremes excluded), preferably by an angle between 20° and 70° (extremes included).

In particular, in the first end-of-stroke position, the second tensioning fin 350 can be perfectly coplanar to the first tensioning fin 315, with the respective end borders 320 and 355 perfectly aligned along a direction parallel to the articulation axis H.

By rotating from the first end-of-stroke position towards the second end-of-stroke position (in the direction illustrated in FIGS. 5 and 12), the inclination of the second tensioning fin 350 with respect to the advancement direction X tends to increase, i.e. the second tensioning fin 355 moves (like the first one) towards a condition of perpendicularity with respect to the advancement direction X (without necessarily reaching it).

In this way, the rotation of the second tensioning fin 350 from the first end-of-stroke position towards the second end-of-stroke position generally causes the end border 355 to move away with respect to the plane in which the covering tape 800 lies at the outlet of the functional arrangement 105, that is in which the covering tape 800 lies as it passes through the cutting device 165 and/or blocking device 180.

In other words, by rotating from the first end-of-stroke position towards the second end-of-stroke position, the end border 355 of the second tensioning fin 350 tends to approach the rotation axis A of the support shaft 125 and, in doing so, tends to increase the inclination between the advancement direction X of the covering tape 800 and the second tensioning fin 350.

A spring 375 is also associated with the second tensioning fin 350, for example but not necessarily a bending spring, which is adapted to push the second tensioning fin 350 to rotate around the articulation axis H from the first end-of-stroke position (in which the spring 375 is loaded to the maximum and therefore exerts the maximum force) towards the second end-of-stroke position.

In this way, the end border 355 of the second tensioning fin 350 is constantly pushed towards and against a longitudinal edge of the covering tape 800 unwinding from the reel 110.

Longitudinal edge always means one of the two edges of the covering tape 800 which extend parallel to the advancement direction, that is, perpendicular to the rotation axis A of the support shaft 125 on which the reel 800 is installed.

In this case, the end border 355 of the second tensioning fin 350 is pushed against the longitudinal edge of the covering tape 800 which, at the reel 700 defines the second end 720 of the roll 710.

In working conditions, in which the axis A of the support shaft 125 is oriented substantially vertically or in any case inclined from the bottom upwards, the longitudinal edge of the covering tape 800, against which the end border 355 of the second tensioning fin 350 abuts, is generally the lower one.

The functional arrangement 105 can also comprise a fixed spatula 380, which can be installed downstream of the cutting device 165, with respect to the advancement direction X of the covering tape 800, and preferably also downstream of the support rollers 160 (if any).

In other words, the fixed spatula 380 may be positioned so that the cutting device 165 is located between the actuation device 190 and the spatula 380.

The fixed spatula 380 can be shaped as a flat sheet, for example rectangular in shape, having at least one end border 385 that extends parallel to the rotation axis A of the support shaft 125.

In particular, the fixed spatula 380 can have a sectional shape (with respect to a plane orthogonal to the axis A) identical to the sectional shape of the first and/or second tensioning fin 315 and 350.

The fixed spatula 380 can be positioned so as to ideally intersect the advancement direction X with which the covering tape 800 exits the functional arrangement 105. The fixed spatula 380 can also be inclined with respect to said advancement direction X, for example by an angle comprised between 0° and 90° (extremes excluded), preferably by an angle comprised between 20° and 70° (extremes included).

For example, the fixed spatula 380 can be arranged so as to be perfectly coplanar with the first and/or second tensioning fin 315 and 350, when the latter are in the first end-of-stroke position, with their respective end borders 385, 320 and 355 perfectly aligned along a direction parallel to the axis A of the support shaft 125.

In particular, the fixed spatula 380 can be positioned so as to be interposed, along this latter direction, between the first tensioning fin 315 and the second tensioning fin 350.

The fixed spatula 330 can be made of a flexible material, such as rubber.

In the embodiment illustrated herein, the functional arrangement 105 can substantially comprise a single rigid structural frame, on which both the support shaft 125 and the actuation device 190 are installed, as well as possibly each of the other devices and apparatuses described above, including for example the cutting device 165, the blocking device 180, the tensioning fins 315 and 350 and finally also the fixed spatula 380.

In particular, this structural frame may comprise at least a first planar structure 340 (see FIGS. 5 and 6), oriented substantially squared with respect to the rotation axis A of the support shaft 125, to which the support shaft 125, the contrast roller 225, and, possibly, the tensioning roller 295 (if any) are connected in a cantilevered manner, so that they all protrude from the same side as explained above.

For example, the first planar structure 340 may comprise two parallel and opposing plates (joined together by suitable connecting bodies), between and above which one or more of the motors and/or of the actuation members already described may be installed.

The structural frame may further comprise a second planar structure 345, defined, for example, by a single plate oriented parallel to the preceding ones, which may serve as a further support element for the not cantilevered components of the functional arrangement 105, such as, for example, the drive roller 195, the cutting device 165, the support rollers 160, the tensioning fins 315 and 350 and the fixed spatula 380.

Said second planar structure 345 is, however, shaped in such a way that it does not face the free ends of the cantilevered components, such as, for example, the support shaft 125, the contrast roller 225 and the tensioning roller 295 (the latter at least when it is in the disengagement position), so that the same are accessible from the outside along a direction parallel to the rotation axis A of the support shaft 125.

In any case, thanks to the presence of the rigid structural frame, all the devices of the functional arrangement 105 described above are constrained to move integrally with each other following any movement imparted to the structural frame.

In other words, the structural frame enables the functional arrangement 105 to be handled as a single rigid body.

Figure 4:
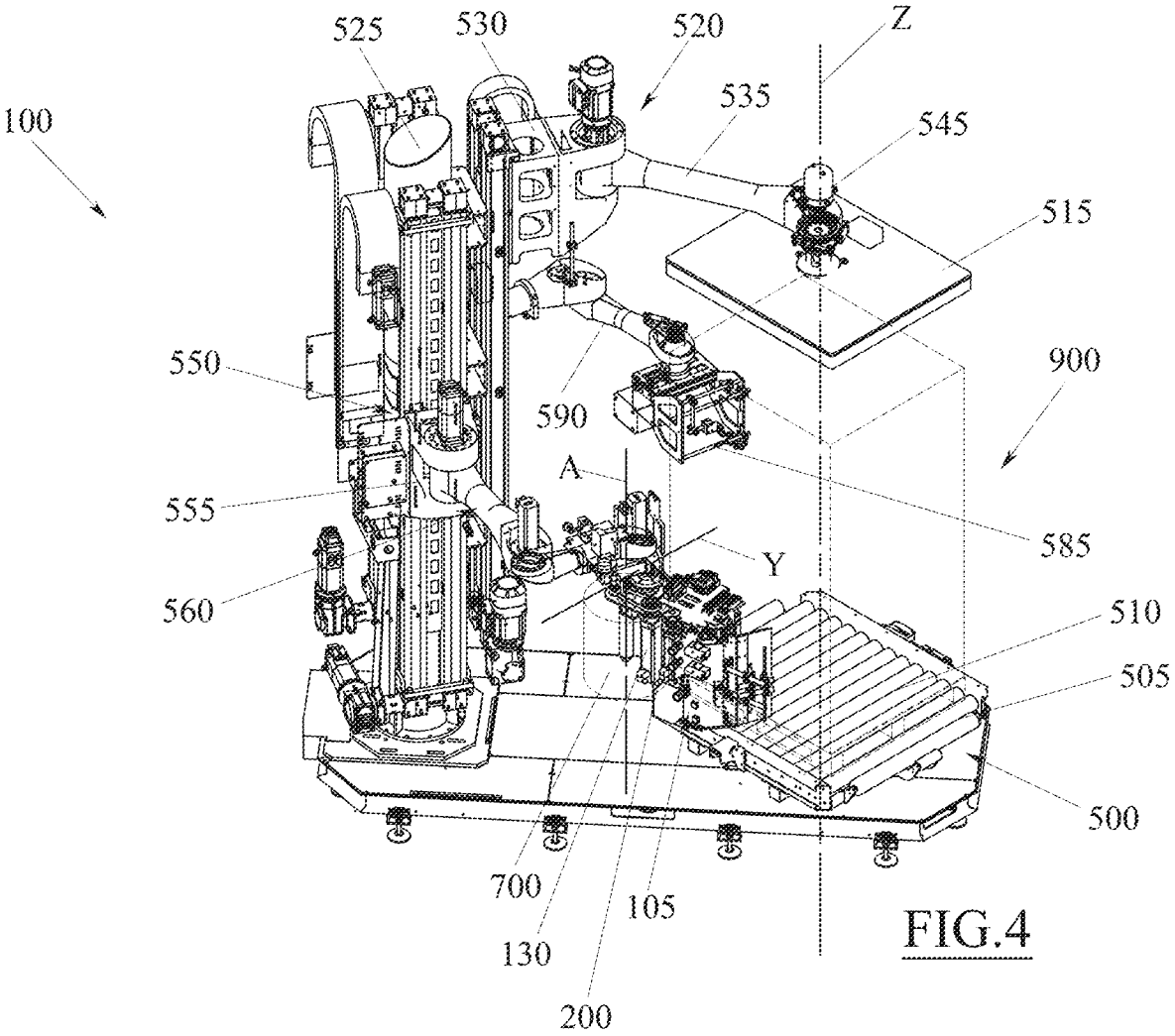
FIG. 4 is an axonometric view of a machine for stabilising palletised loads according to an embodiment of the present invention.

In this regard, the machine 100 can comprise a first movement apparatus 500 adapted to produce a relative motion of revolution of the functional arrangement 105 around the palletised load 900, with respect to a predetermined, preferably vertical, revolution axis Z (see FIG. 4).

Relative motion of revolution means that the functional arrangement 105 rotates around the palletised load 900 with respect to a reference system integral with the palletised load 900, regardless of whether the actual movement is imparted to the functional arrangement 105 or to the palletised load 900.

Thus, for example, in the illustrated embodiment, the first movement apparatus 500 is actually adapted to put the palletised load 900 in rotation on itself.

For this purpose, the first movement apparatus 500 can comprise a platform 505, which makes a rest surface 510, preferably horizontal, available for the palletised load 900.

In particular, the rest surface 510 can be defined by a roller conveyor which, when installed on the platform 505, facilitates the positioning and subsequent distancing of the palletised load 900.

The first movement apparatus 500 further comprises actuator members (not illustrated) adapted to put the platform 505 in rotation around a rotation axis orthogonal to the rest surface 510 and coincident with the axis, for example substantially vertical, of revolution Z.

In particular, the rotation axis of the platform 505 can pass internally to the rest surface 510, so that the palletised load 900 can substantially pivot on itself.

In a position superimposed on the rest surface 510; the machine 100 can comprise an upper pad 515, which is adapted to stay in contact with the top of the palletised load 900.

This upper pad 515 can be substantially shaped as a flat plate, for example substantially rectangular/square in shape, and oriented horizontally.

The upper pad 515 can be associated with a lifting apparatus 520 adapted to move it in the vertical direction, so as to bring it closer to and away from the rest surface 510, for example to free the palletised load 900 or to adjust the position thereof according to the height of the latter.

This lifting apparatus 520 can comprise for example a support column 525 and a carriage 530 slidingly associated with the support column 525, so as to be able to slide on it in a vertical direction, driven by suitable motors.

In particular, the support column 525 can be provided with linear sliding guides, oriented vertically, on which corresponding coupling runners fixed to the carriage 530 slide.

The lifting apparatus 520 can further comprise a cantilevered, preferably horizontal, arm 535 which connects the carriage 530 to the upper pad 515.

To allow a correct positioning of the upper pad 515, one end of the cantilevered arm 535 can be articulated to the carriage 530 according to a vertical articulation axis, so that the cantilevered arm 535 can rotate like a flag.

This rotation of the cantilevered arm 535 can be driven by an electric motor.

The upper pad 515 can also be adapted to rotate on itself around an axis of vertical rotation, which is coincident (or can be brought so as to be coincident) with the revolution axis Z.

For example, the upper pad 515 can be hinged, according to said rotation axis, to a second end of the cantilevered arm 535, and can be drive for rotation by a motor 545 or by any other actuator member.

In particular, it is preferable that the rotation of the upper pad 515 occurs substantially simultaneously and substantially at the same speed as the rotation of the platform 505, so that the palletised load 900 is not subjected to significant torsional stresses.

Although in the previous description reference has been made to a first movement apparatus 500 adapted to rotate the palletised load 900, it is not excluded that, in other embodiments, the palletised load 900 may remain stationary, for example resting on a rest surface 510 made available by a floor or any other fixed base, and that the first movement apparatus 500 is configured to actively move the functional arrangement 105 with a revolution movement around the palletised load 900.

Also in this case, the machine 100 could in any case comprise an upper pad 515 adapted to remain in contact and integral with the top of the palletised load 900 (in this case also stationary).

Regardless of these considerations, the machine 100 further comprises a second movement apparatus 550, which is adapted to produce a relative motion of translation of the functional arrangement 105 with respect to the palletised load 900, along a direction parallel to the revolution axis Z, or preferably in the vertical direction.

Relative motion of translation means that the functional arrangement 105 and the palletised load 900 are mutually movable in a direction parallel to the revolution axis Z, regardless of whether the actual movement is of one or the other.

Thus, for example, in the illustrated embodiment, the second movement apparatus 550 is adapted to actively move the functional arrangement 105 in the vertical direction, while the palletised load 900 remains stable on the rest surface 510.

However, it is not excluded that, in other embodiments, the second movement apparatus 550 may be configured to move the palletised load 900 vertically, for example by lifting and/or lowering the corresponding platform 505.

In any case, the second movement apparatus 550 is preferably configured to also allow a displacement of the functional arrangement in a plane orthogonal to the revolution axis Z, that is in a preferably horizontal plane, as well as to allow a variation in the orientation of the functional arrangement 105, and consequently of the rotation axis A of the reel 700, through rotation around a further oscillation axis Y perpendicular to the revolution axis Z, that is preferably horizontal.

To obtain these degrees of freedom, the second movement apparatus 550 can first of all comprise a support column and a carriage 555 slidingly associated with said support column, so as to be able to slide vertically thereon; driven by suitable motors.

In the illustrated example, the support column of the second movement apparatus 550 can coincide with the support column 525 of the lifting apparatus 520 of the upper pad 515.

In particular, the support column 525 can be provided with linear sliding guides, oriented vertically, on which corresponding coupling runners fixed to the carriage 555 slide.

The second movement apparatus 350 can further comprise a cantilevered arm 560, preferably horizontal, which connects the carriage 555 to the functional arrangement 105, that is to the structural frame thereof.

The cantilevered arm 560 can be an articulated arm with parallel, for example all vertical, axes to allow a more efficient positioning of the functional arrangement 105.

In particular, the cantilevered arm 560 can comprise two stretches in series, of which a first stretch articulated to the carriage 555 and a second stretch articulated to the free end of the first stretch.

The rotation of the first stretch with respect to the carriage 555 can be driven by an electric motor, while the rotation of the second stretch with respect to the first stretch can be driven by another electric motor.

In practice, the carriage 555 and the cantilevered arm 560 define a so-called SCARA robot.

The structural frame of the functional arrangement 105 can be connected to the cantilevered arm 560, that is to the free end of the second stretch, by interposition of a first articulated joint which allows it to rotate around an articulation axis parallel to that defined between the cantilevered arm 560 and the carriage 555, or preferably vertical.

The rotation of the structural frame of the functional arrangement 105 with respect to this articulation axis can be driven by a dedicated electric motor.

In addition or alternatively, the structural frame of the functional arrangement 105 can be connected to the cantilevered arm 560 by means of an additional articulated joint defining the already mentioned oscillation axis Y.

The rotation of the functional arrangement 105 with respect to this oscillation axis Y can be driven by a further dedicated electric motor.

The machine 100 further comprises a gripping device 565 (see FIG. 13), which is adapted to grasp a first free end of the covering tape 800 unwinding from the reel 700 mounted on the functional arrangement 105, to make it integral with the palletised load 900.

This gripping device 565 can be positioned at the base of the palletised load 900 and is adapted to remain integral with the latter during the relative revolution and translation movements of the functional arrangement 105.

For example, the gripping device 565 can be installed on board the platform 505.

However, it is not excluded that, in other embodiments, the gripping device 565 may be positioned at the top of the palletised load 900, for example on board the upper pad 515.

As illustrated in FIG. 13, this gripping device 565 can comprise a gripper member 570 provided with at least two jaws that are reciprocally movable towards and away from each other, so as to be able to selectively clamp or release an edge of the covering tape 800 which is positioned between them.

This movement of the jaws of the gripper member 570 can be driven by means of a cylinder-piston arrangement of the pneumatic type or by any other actuation system, for example electromechanical.

The jaws of the gripper member 570 can protrude from the rest plane 510 defined by the platform 505 towards the upper pad 515, in such a way as to be at least partially flanked to the side wall of the palletised load 900, in particular to the pallet 905.

The gripping device 565 can further comprise actuator members 575 adapted to move the gripper member 570 along a predetermined sliding direction, towards and away from the revolution axis Z, and therefore with respect to the side wall of the palletised load 900.

The sliding direction of the gripper member 570 can be orthogonal to the revolution axis Z, for example horizontal.

The actuator members 575 may comprise a cylinder-piston arrangement of the pneumatic type or any other type of actuator, for example electromechanical, adapted to make the gripper member 570 slide.

Other actuator members (not illustrated), for example another pneumatic cylinder-piston arrangement, can be provided to move the gripper member 570 also in a direction parallel to the revolution axis Z.

In addition to what has been described so far, the machine 100 further comprises a fixing device 580, which is adapted to fix the windings of covering tape 800 around the palletised load 900.

In the illustrated embodiment, this fixing device 580 is installed directly on board the functional arrangement 105, i.e., connected to its structural frame.

In other embodiments, the fixing device 580 could be installed on an independent frame 585, which can in turn be associated with a third movement apparatus 590, for example with a further SCARA robot, which is adapted to move the fixing device 580 at least along a direction parallel to the revolution axis Z, for example vertical, and, more preferably, also in multiple positions in the plane orthogonal to said revolution axis Z, so as to be able to suitably place it with respect to the palletised load 900.

As illustrated in FIGS. 7 to 10, this fixing device 580 comprises one or more guns for dispensing an adhesive adapted to be applied on the windings of the covering tape 800.

For example, these dispensing guns can comprise one or more dispensing guns of a hot glue and, optionally, one or more dispensing guns of a cold glue.

However, it is not excluded that, in other embodiments, the fixing device 580 may comprise only hot glue dispensing guns or only cold glue dispensing guns.

Nor is it excluded that other embodiments may provide for replacing the adhesive dispensing guns with nail guns, staple guns, banding devices or any other device suitable for applying an element, substance or treatment that allows to join and/or to keep the windings of the covering tape 800 joined.

In the light of what has been described above, the operation of the machine 100 is described below.

Initially, the palletised load 900 is loaded onto the rest surface 510 and the upper pad 515 is brought into contact with the top thereof, possibly causing it to exert a certain downward pressure.

While the palletised load 900 is stationary in this position, the functional arrangement 105 can be oriented, by means of the second movement apparatus 550, in such a way that the rotation axis A of the reel 700 and thus the orientation of the covering tape 800 are substantially parallel to the revolution axis Z, i.e., substantially vertical.

Again by means of the second movement apparatus 550, the functional arrangement 105 can be brought close to the palletised load 900 and at the gripping device 565, so that a first (free) end of the covering tape 800 associated with the reel 700, i.e., the one protruding downstream of the cutting device 165, can be vertically aligned with the gripper member 570.

At this point, the gripper member 570 can be raised, so that said first end of the covering tape 800 slips between the jaws thereof, which are subsequently clamped together in order to seize it and hold it firmly.

Subsequently, the gripper member 570 can be moved towards the revolution axis Z, dragging therewith the covering tape 800 (which therefore begins to unwind from the reel 700), until it is positioned in the immediate vicinity of the side wall of the palletised load 900.

At the end of this step, the platform 505 and the upper pad 515 can be put in rotation around the revolution axis Z, by activating the rotation of the palletised load 900 as well.

In this way, the reel 700 which is on board the functional arrangement 105 begins to perform a relative revolution movement around the palletised load 900.

During this revolution movement, since the first end of the covering tape 800 remains integral with the palletised load 900, the covering tape 800 is automatically dragged so as to unwind from the reel 700 and to wind around the palletised load 900.

This unwinding of the covering tape 800 can be assisted and, possibly, controlled by simultaneously driving the support shaft 125 by the motor 130.

During winding, the actuation device 190 of the functional arrangement 105 can be inactive, for example with the drive roller 195 stationary and the contrast roller 225 in a distanced configuration.

More preferably, the drive roller 195 and the contrast roller 225 may however be kept in a neared configuration, using the drive roller 195 as a brake, so that the covering tape 800 remains suitably taut.

Thereafter, while the palletised load 900 continues to rotate, the second movement apparatus 550 can begin to displace the functional arrangement 105 in a vertical upward direction.

In this way, the covering tape 800 is wound around the palletised load 900 with a spiral course, until it completely covers the side wall.

Since the covering tape 800 can be substantially inextensible, in order to accompany this spiral course, the second movement apparatus 550 orients the functional arrangement 105, by making it rotate around the oscillation axis Y (or allowing it to rotate around the oscillation axis Y), in such a way that the rotation axis A of the reel 700 always remains substantially orthogonal to the direction of the helix.

During each rotation of the palletised load 900, the dispensing guns of the fixing device 580 can dispense (e.g., spray) a certain amount of adhesive onto the winding of the covering tape 800 that has been previously made, so that said adhesive remains interposed between the previous winding and the one being made, joining them together and making the wrapping more stable.

In particular, the adhesive used in this step can be the cold glue.

At the top of the palletised load 900, the translational movement of the functional arrangement 105 is stopped and it can be made to rotate around the oscillation axis Y, so as to bring back the rotation axis of the reel 700 vertically.

At this point it is possible to make a few final windings of the covering tape 800, with a horizontal course and perfectly superimposed one another, at the top of the palletised load 900.

Of course, if the gripping device 565 were placed on the upper pad 515, the winding of the palletised load 900 would take place in the opposite direction from top to bottom.

In any case, during the winding process of the palletised load 900, it may happen that the rotation of the functional arrangement 105 around the oscillation axis Y is too slow to adapt to the variations in inclination of the covering tape 800, especially when the winding speed is quite high.

This entails that one or both longitudinal edges of the covering tape 800 may lose tension, forming loops and/or ripples which do not adhere to the palletised load 900.

These tension losses are however recovered by the tensioning fins 315 and 350 which are constantly pushed by the respective springs 345 and 375 against the opposite longitudinal edges of the covering tape 800 and are therefore adapted to slide on them.

In fact, if one of these longitudinal edges loses tension and becomes slack, the corresponding tensioning fin would be pushed by the respective spring to rotate towards and against the longitudinal edge itself, locally varying its shape until it recovers enough tension to counteract the thrust of the spring itself (see FIGS. 14 and 15).

In this way, the longitudinal edge always remains taut like the remaining portions of the covering tape 800, ensuring better adherence to the palletised load 900 and therefore a better stability of the winding.

At the end of the winding, the platform 505 and the upper pad 515 can be stopped. The dispensing guns of the fixing device 580 can therefore be commanded for dispensing (e.g., spraying) a certain amount of adhesive onto the portion of the envelope facing the last stretch of the covering tape 800 coming from the reel 700. The adhesive used in this step can be hot glue, as it is characterized by shorter setting times than cold glue.

Through the second movement apparatus 550, the functional arrangement 105 can then be approached to the palletised load 900, so as to begin to bring the last stretch of the covering tape 800 coming from the reel 700 into contact with the palletised load 900, above the previously dispensed adhesive.

At the same time, the cutting device 165 comes into operation which separates the segment of covering tape 800 wound around the palletised load 900 from the one that remains connected to the reel 700.

In this way, the segment of covering tape 800 wound around the palletised load 900 will have a second free end, which can be stretched and pressed against the adhesive previously dispensed by means of the end borders 320, 355 and 385 of the tensioning fins 315 and 350 and of the spatula 380 which, by means of the second movement apparatus 550, are brought into contact and suitably made to slide against the previously wound palletised load 900.

The segment of covering tape 800 which remains associated with the reel 700 will now have a new free end positioned at the cutting device 165, for example retained by the blocking device 180.

In order to make this free end protrude beyond the cutting device 165, for example beyond the support rollers 160, and thus make it available for stabilising another palletised load 900, the actuation device 190 can now be put into operation.

In particular, the contrast roller 225 can be brought into contact with the drive roller 195 and the latter can be driven for rotation, so as to unwind at least a part of the covering tape 800 from the reel 700, thus making it advance until the free end will be sufficiently protruding to be seized again by the gripper member 570 of the gripping device 565.

The operation of the machine 100, as outlined above, can be entirely commanded and controlled by at least one electronic unit (not illustrated), which is suitably programmed and connected with the various devices and apparatuses of the machine 100.

Obviously, an expert in the field may make several technical-applicative modifications to all that above, without departing from the scope of the invention as hereinbelow claimed.

The invention claimed is:

1. A machine for stabilising palletised loads, comprising:

a functional arrangement provided with a reel of a covering tape, a gripping device adapted to take a first end of the covering tape of the reel and to make the covering tap integral with the palletised load, a first movement apparatus adapted to generate a relative motion of revolution of the functional arrangement around the palletised load, according to a predetermined revolution axis (Z), so as to unwind the covering tape from the reel and to wind the covering tape around the palletised load, a second movement apparatus adapted to generate a relative motion of translation of the functional arrangement with respect to the palletised load in a direction parallel to the revolution axis (Z), so as to wind the covering tape, which continues to unwind from the reel, like a spiral around the palletised load, a cutting device placed in the functional arrangement to separate the covering tape from the reel, and fixing device adapted to fix at least a second end of the covering tape to the palletised load, wherein the functional arrangement further comprises:

at least a first tensioning fin, which is adapted to rotate around an articulation axis (H) parallel to the axis (A) of the reel and is provided with a rectilinear end border, distal with respect to the articulation axis (H) and extending parallel to the articulation axis (H), which is adapted to stay in contact with a longitudinal edge of the covering tape unwinding from the reel, and a first spring adapted to act on the first tensioning fin to push the end border thereof against said longitudinal edge of the covering tape.

2. The machine according to claim 1, wherein the first tensioning fin is positioned so that the end border stays in contact with the longitudinal edge of the covering tape, in a stretch downstream of the cutting device with respect to a sliding direction (X) of the covering tape unwinding from the reel.

3. The machine according to claim 1, wherein the first tensioning fin is made of a flexible material.

4. The machine according to claim 1, wherein the longitudinal edge of the covering tape on which the first tensioning fin acts is the upper longitudinal edge.

5. The machine according to claim 1, wherein the functional arrangement further comprises:

at least a second tensioning fin, which is adapted to rotate around an articulation axis (H) parallel to the axis (A) of the reel and is provided with a rectilinear end border, distal with respect to the articulation axis (H) and extending parallel to the articulation axis (H), which is adapted to stay in contact with an opposite longitudinal edge of the covering tape unwinding from the reel, and a second spring adapted to act on the second tensioning fin to push the end border thereof against said opposite longitudinal edge of the covering tape.

6. The machine according to claim 5, wherein the articulation axis (H) of the second tensioning fin coincides with the articulation axis (H) of the first tensioning fin.

7. The machine according to claim 6, wherein the distances between the articulation axis (H) and the end borders of said first and second tensioning fins are the same.

8. The machine according to claim 5, wherein said first and second spring are the same.

9. The machine according to claim 5, wherein the second tensioning fin is made of a flexible material.

10. The machine according to claim 5, wherein the functional arrangement comprises a fixed spatula, which is interposed between the first tensioning fin and the second tensioning fin along the direction defined by the articulation axes (H), said spatula being provided with a rectilinear end border, which is aligned with the end border of the first tensioning fin and with the end border of the second tensioning fin, when both the first tensioning fin and the second tensioning fin are in an angular end-of-stroke position, in which the thrust exerted by the respective first and second springs is maximum.

11. The machine according to claim 10, wherein the spatula is made of a flexible material.

* * * * *